United States Patent [19]

Barber

[11] Patent Number: 4,529,439

[45] Date of Patent: Jul. 16, 1985

[54] ENERGY CONSERVATION DURING THE SMELTING OF ORES

[75] Inventor: James C. Barber, Florence, Ala.

[73] Assignee: James C. Barber and Associates, Inc., Florence, Ala.

[21] Appl. No.: 651,589

[22] Filed: Sep. 17, 1984

[51] Int. Cl.[3] ..... C22B 4/00

[52] U.S. Cl. ..... 75/10 R; 75/3; 75/6; 75/11

[58] Field of Search ..... 75/3, 6, 11, 10 R

[56] References Cited

U.S. PATENT DOCUMENTS

| | | | |
|---|---|---|---|
| 3,215,522 | 11/1965 | Kuhlmann | 75/11 |
| 3,276,859 | 10/1966 | Collin | 75/11 |
| 3,495,971 | 2/1970 | Ban | 75/11 |
| 3,912,501 | 10/1975 | De Castejon | 75/11 |

OTHER PUBLICATIONS

Burt & Barber, "Production of Elemental Phosphorus by the Electric-Furnace Method", Ch. E. Rep. No. 3, (Tennessee Valley Auth. 1952).

*Primary Examiner*—Peter D. Rosenberg

[57] ABSTRACT

The invention discloses processes for preparing matched sizes of electric furnace feed materials. With the matched sizes, components of the feed mixture do not separate inside the furnace and this decreases the electric energy for smelting. Preparation of matched sizes of materials is made possible by low-temperature agglomeration followed by drying to indurate the agglomerates. Fuel requirements for induration are substantially reduced, and environmental problems associated with high-temperature agglomeration are eliminated. Phosphate ores can be agglomerated and simultaneously the ores are upgraded by increasing the $P_2O_5$ content. Unbeneficiated phosphate ores heretofore considered unsuited for smelting can be used as phosphate sources for the production of phosphorus. A combustible gas consisting mainly of carbon monoxide and hydrogen is generated when ores are smelted. Processes are disclosed for cleaning the gas to permit it to be burned in a facility for the cogeneration of electric energy. At phosphorus furnaces the potential energy in the gas is equal to about 65 percent of the electric energy used in smelting; consequently, the net electric energy consumption can be substantially reduced by operation of a cogeneration facility.

10 Claims, 4 Drawing Figures

AIR HEATER

POWER CHART FOR PHOSPHORUS FURNACE

PRESSURE CHART FOR PHOSPHORUS FURNACE

PROCESS FOR AGGLOMERATING FURNACE FEED MATERIALS

AIR HEATER

ENERGY CONSERVATION DURING THE SMELTING OF ORES

BACKGROUND OF THE INVENTION

In the present invention, processes are described which will reduce the energy required to smelt ores, and the processes will result in decreased expenditure for pollution abatement. Technology is available for smelting ores by heating them to high temperatures with a carbon source wherein the carbon combines with the oxygen associated with the ore to form carbon monoxide gas. However, large amounts of electric energy are consumed in smelting the ores. The technology can be advanced by developing processes and equipment to reduce the energy requirement. Energy can be conserved by effectively utilizing the potential energy in byproduct carbon monoxide gas.

The carbon monoxide gas forms in the high-temperature smelting zone of furnaces and it flows upward through the solid feed material. Heat is exchanged between the gas and the solids; the gas is cooled, and the solids are heated. This preheating of the feed mixture decreases the energy required for smelting. Present technology does not provide for efficient exchange of heat between the gas and feed mixture.

The invention is applicable to submerged arc electric furnaces operated as described above. These furnaces normally have three vertical electrodes that extend through the furnace roof into the feed mixture. Electric arcing occurs between the bottom of the electrodes and the furnace bottom. The furnace crucible is normally lined with carbon or graphite blocks joined with carbonaceous cement since this construction resists the high temperature and corrosive environment inside the furnace. FIG. 71 in the publication, "Production of Elemental Phosphorus by the Electric-Furnace Method," Chemical Engineering Report No. 3, Tennessee Valley Authority, National Fertilizer Development Center, Muscle Shoals, Ala. 35660, is a general arrangement of a submerged arc phosphorus furnace at which the electrodes are in line. FIG. 95 in the publication is a general arrangement of a round furnace at which the electrodes are disposed in a triangular arrangement. These diagrams show the geometry of the submerged arc electric furnace, and they may aid in understanding the present invention.

Ores smelted in submerged arc furnaces usually occur as small particles, but sometimes they occur as consolidated rocks which must be crushed and screened to obtain a size suitable for smelting. Fines are formed when the rocks are crushed and screened. The fines are unsuited for use in submerged arc furnaces because the gas velocity is high enough to suspend the small particles and they leave the furnace with the gas stream.

Technology is available to agglomerate discrete particles of ore. One process commonly used to agglomerate phosphate ore is called nodulizing. The ore is heated in a rotary kiln to a temperature high enough to melt part of the ore and thereby form a liquid phase. When unbeneficiated phosphate ore is nodulized the rotary kiln is heated to the temperature range of 2550° to 2650° F. Beneficiated phosphate ores must be heated to higher temperatures to obtain sufficient liquid phase for agglomeration, and the kiln lining is rapidly deteriorated. The mixture of melted and unmelted material is tumbled by rotation of the kiln forming agglomerates having a wide range of sizes. The proportion of liquid phase is poorly controlled and the kiln discharge will vary from unagglomerated fines to huge balls. Needless to say, large amounts of fuel are required to heat the kiln. The energy required for unbeneficiated phosphate ore is about 33 million Btu per ton of phosphorus produced. Of course, more energy is required for beneficiated ore.

Other agglomeration processes are available which require less energy, but more steps are involved in the process. The quality of the agglomerates may be no better than nodules. In one process moist ore is preformed into pellets, briquets, or other shapes. However, the agglomerates are too weak and they contain too much moisture to be fed to electric furnaces. The preformed shapes are indurated by heating to temperatures just below the point at which fusion begins. Fluorapatite mineral rapidly crystallizes and the agglomerates gain strength by crystal interlocking. The induration temperature for phosphate ore is in the range of 2200° to 2300° F. and the energy consumption is about 27 million Btu per ton of phosphorus produced. In addition, about 7.3 million Btu per ton of phosphorus is required for partial drying of unbeneficiated phosphate ore. The publication, "Agglomeration of Phosphate Fines for Furnace Use," Chemical Engineering Report No. 4, Tennessee Valley Authority, National Fertilizer Development Center, Muscle Shoals, Ala. 35660, provides information on the development of processes to agglomerate phosphate ores.

The term "high-temperature agglomeration" is used herein to denote those processes in which part of the ore is melted to form a liquid phase as in nodulizing. Or the term applies to processes wherein preformed agglomerates are indurated by heating to temperatures high enough to provide agglomerate strength by crystal interlocking. Fluorapatite begins to crystallize at about 1800° F.

"Low-temperature agglomeration" is used to denote an agglomeration process disclosed in U.S. Pat. Nos. 4,372,929 and 4,373,893. Finely divided solids are tumbled in a rotating cylinder with a salt solution. The salt solution is formed in situ. The resulting agglomerates are indurated by drying at 250° F., or higher. The salt is calcium phosphate or ammonium phosphate when phosphorus furnace feed materials are agglomerated. The energy to indurate agglomerates prepared from phosphate ore was estimated to be 7.3 million Btu per ton of phosphorus produced.

The equipment used in high-temperature agglomeration must be rugged in order to operate at elevated temperatures. The investment and operating costs are high, and air and water pollution abatement causes operating problems. The investment cost for high-temperature agglomeration at a phosphorus plant is about a third of the total cost. Small particles of ore are entrained in air during handling, resulting in a polluted workroom environment. Energy must be expended to treat large amounts of dust-laden air to remove dust for industrial hygiene control. Phosphate ores contain fluorine and part of the fluorine volatilizes when the ores are heated. Collection of fluorine from stack gases further contributes to the cost of air pollution abatement.

In high-temperature agglomeration the material must be cooled, screened, crushed, conveyed, and stored. Sometimes agglomerates are stored outside and this results in deterioration from exposure to the weather and from extra handling in taking material into and out of storage. Agglomerated ore contains a wide range of particle sizes and this results in the separation of large particles from small ones in storage, in the furnace feed bin, and in the furnace. This separation of the particles is called segregation.

Studies were undertaken to determine the magnitude of the segregation problem and to determine benefits that would result from feeding of uniformly sized materials. A special test was made at a 9,000-kW phosphorus furnace to obtain such data. The phosphate being smelted was agglomerated by nodulizing; the reducing carbon was metallurgical coke and the flux was silica rock. The nodulized phosphate had an average particle size of 0.8-inch, coke 0.3- to 0.4-inch, and the silica rock was slightly larger than the nodules. The furnace was being operated normally when it was shut down, and the mixture inside was sampled by taking core drill samples which were removed through three poke holes in the furnace roof. Results of the analyses of these samples are given in table 1.

TABLE 1

Analysis of Samples of Core Drillings Taken from a 9,000-kW Phosphorus Furnace

| Distance from furnace roof | $P_2O_5$, percent | Carbon, percent | $SiO_2$:CaO weight ratio |
|---|---|---|---|
| Samples taken from poke hole nearest furnace offtake | | | |
| 4'5" to 5'1" | 27.0 | 5.9 | 0.87 |
| 5'1" to 5'7" | 27.4 | 4.2 | 0.78 |
| 5'7" to 6'0" | 26.6 | 1.3 | 0.76 |
| 6'0" to 6'8" | 26.0 | 0.7 | 0.82 |
| 6'8" to 7'5" | 26.1 | 3.7 | 0.83 |
| 7'5" to 7'11" | 23.0 | 11.5 | 0.90 |
| 7'11" to 8'2" | 23.9 | 10.2 | 0.83 |
| 8'2" to 8'6" | 23.4 | 12.4 | 0.84 |
| 8'6" to 8'10" | 21.6 | 13.5 | 0.87 |
| Samples taken from center poke hole | | | |
| 4'0" to 4'8" | 26.4 | 7.6 | 0.70 |
| 4'8" to 5'3" | 26.4 | 4.0 | 0.70 |
| 5'3" to 5'9" | 26.7 | 2.1 | 0.77 |
| 5'9" to 6'3" | 22.7 | 10.9 | 0.87 |
| 6'3" to 6'9" | 22.0 | 15.1 | 0.88 |
| 6'9"to 7'2" | 22.9 | 13.5 | 0.80 |
| 7'2" to 8'3" | 16.2 | 21.0 | 0.94 |
| 8'3" to 9'8" | 6.2 | 35.8 | 1.44 |
| Samples taken from poke hole farthest from furnace offtake | | | |
| 6'0" to 6'5" | 30.3 | 9.2 | 0.74 |
| 6'5" to 7'0" | 27.7 | 5.7 | 0.77 |
| 7'0" to 7'5" | 24.2 | 10.8 | 0.79 |
| 7'5" to 8'0" | 22.0 | 16.8 | 0.76 |
| 8'0" to 8'8" | 19.4 | 11.9 | 0.86 |
| 8'8" to 9'3" | 17.0 | 13.4 | 0.86 |

The chemical composition of the mixture inside the furnace varied widely as shown in table 1. The samples contained 19 to 304 percent of the carbon needed to react with the phosphate ore to produce elemental phosphorus. One sample had 1377 percent of the carbon needed, but it probably contained coke fines which had accumulated inside the furnace. Coke fines are ineffective for the reduction of phosphate. The fines collect in the bottom of the furnace and they are tapped out with the slag. The $SiO_2$:CaO weight ratio in core drill samples varied from 0.70 to 1.44, but the desired ratio was 0.85. The wide variations of both the carbon content and the $SiO_2$:CaO weight ratio were attributed to segregation of the materials wherein the phosphate, coke, and silica rock separated from each other because of their differences in particle size. The feed materials form conical-shaped piles when they are fed into the furnace through feed chutes; large particles roll down the surface of the cone, but small particles remain at the apex. It is impractical to install any mechanical devices inside the smelting furnace to prevent this coning.

Segregation was a subject of considerable study in the fertilizer industry because mixed fertilizers must be homogeneous to assure that the guaranteed nutrient contents of the mixtures are constant. It was found that segregation occurs when components of a solid mixture have different particle sizes. Under ideal conditions the average size and size distribution of the components of a solid mixture should be the same, and the mixture is said to have matched sizes.

A special test was carried out at a phosphorus furnace to investigate the benefits that might be realized by using matched sizes of materials as a feed mixture. Unbeneficiated phosphate ore was selected which had a $SiO_2$:CaO weight ratio of 0.85; therefore, no silica rock was needed. The ore was agglomerated by briquetting. The unbeneficiated ore contained enough clay to provide binder to make briquets which were indurated by heating them in a rotary kiln. Breakage of the briquets was severe, and it was apparent this method of agglomeration and induration would be impractical on a commercial scale. Nevertheless, sufficient material approximately 1 inch in size was obtained by screening to make a short furnace test. Large size metallurgical coke was purchased, and this material was crushed and screened so that particles about 1 inch in size were obtained. The phosphate ore had an average particle size of 1.02 inches and the coke had an average size of 1.01 inches.

FIG. 1 shows sections of the power chart prior to the test with matched sizes of materials and during this test. Prior to the test the phosphate was agglomerated by nodulizing and unmatched sizes of agglomerated ore, metallurgical coke, and silica rock were being fed to the furnace. The powerload varied widely as shown on the left-hand side of FIG. 1. There were deep dips to only 1,000 to 2,000 kW loads and numerous smaller dips to 5,000 to 6,000 kW loads. The average powerload was 13.8 percent less than the set load of 9,400 kW.

The right side of FIG. 1 shows the powerload with matched sizes of charge materials. The chart shows that no large dips occurred, and the average powerload was only 1.3 percent less than the set load. These data indicate that the capacity of a phosphorus furnace can be increased substantially by changing from unmatched to matched sizes of feed materials.

FIG. 2 is the pressure chart for the first day of the test and it shows that a marked difference was obtained when a change was made from unmatched to matched sizes of feed materials. Part of the chart shows pressure variations during normal operation when the ore was being agglomerated by nudulizing. The decrease in pressure variations when the change was made from nodules to briquets is readily discernible.

Furnace pressure fluctuations are an important index of of the performance. Wide fluctuations denote negative pressure part of the time, and air will be brought into the furnace through feed chutes and openings in the roof. Analysis of the furnace gas showed much less air was entering the furnace with matched sizes of feed materials than with unmatched sizes. Elemental phosphorus is oxidized to $P_2O_5$ by the air and the $P_2O_5$ is ultimately discharged as waste in condenser water. Electric energy was consumed in smelting the phosphate ore to reduce the oxidized phosphorus, and matched sizes of feed materials will therefore lower the electric energy requirement.

Positive pressure is accompanied by leakage of furnace gases through feed chutes and openings in the furnace roof. The escape of elemental phosphorus causes fumes in the workroom environment, as well as phosphorus loss. Most of the furnace gas is carbon monoxide and its escape into the workroom can be dangerous. However, use of matched sizes of feed materials substantially reduces the pressure surges which can cause a dangerous environmental condition.

Wide variations in pressures indicate that the gas is channeling through the feed materials inside the furnace. The exchange of heat between the hot gas and the feed mixture is poor. With matched sizes of feed materials the furnace gas temperature held steady at about 475° F., which was about 200° F. lower than the average temperature with unmatched materials. Therefore, additional electric energy is saved by improved heat exchange inside the furnace.

Phosphorus furnace gases contain elemental phosphorus and noncondensable gases, but most of the noncondensable gas is carbon monoxide. About 6 percent of the gas by volume is phosphorus and the dewpoint is 460° F. The furnace gas temperature must be kept above this value to avoid problems from the condensation of phosphorus inside the furnace, in the furnace offtake, and in the electrostatic precipitator. A minimum furnace gas temperature of 500° F. is proposed to provide a margin of safety of about 40° F.

Heretofore, phosphorus furnaces were constructed with depths which would assure that the dewpoint of phosphorus was not reached, but the average gas temperature was substantially above the dewpoint. With the matched sizes of feed materials it will be possible to design for steady gas temperatures and the difference between the average gas temperature and the dewpoint can be decreased. Additional heat can be extracted from the furnace gas and less electrical energy will be required for smelting.

Various carbonaceous materials are capable of reacting with phosphate ores to produce elemental phosphorus. But many of the materials are unsuited as reducing carbons because they are comprised of small particles. Metallurgical coke is commonly purchased for use as a reducing carbon in phosphorus furnaces. Unfortunately, metallurgical coke usually contains about 12 percent of material smaller than 10 mesh, and use of the fine coke adversely affects the furnace operation. Furthermore, the small sized coke is ineffective as a reducing carbon.

Practical processes were not available for the agglomeration of small sized carbonaceous materials prior to disclosures in U.S. Pat. No. 4,421,521, Dec. 20, 1983. Metallurgical coke fines can be agglomerated by the low-temperature process described above to make particles large enough to be used as a reducing carbon. When the reducing carbon is metallurgical coke, about 80.9 million Btu of energy are required in smelting to produce a ton of elemental phosphorus. Forty-seven percent of the energy is metallurgical coke and 53 percent is electric energy. An energy saving of about 4.6 million Btu per ton of phosphorus can be obtained by agglomeration of the coke fines. Additional energy savings may be obtained by agglomerating low-cost carbonaceous materials and using these materials as reducing carbons. For example, agglomerated anthracite coal fines can be used as a reducing carbon and cost of phosphorus production will be further reduced.

DISCLOSURES IN THE INVENTION

Prior to 1983 no practical processes were available for the preparation of matched sizes of charge materials. U.S. Pat. Nos. 4,372,929; 4,373,893; and 4,421,521 disclosed low-temperature agglomeration processes, and these processes can be applied at smelting furnaces. Ore particles are embedded in a salt matrix and induration is carried out at low temperatures. Carbon particles are agglomerated and energy is conserved by agglomerating the small size reducing carbon. Other carbonaceous materials such as forest wastes and sewage sludge may be agglomerated and used as reducing carbons.

The present invention discloses processes for smelting ore wherein matched sizes of feed materials are prepared and indurated. The heated agglomerates are discharged from the indurating equipment into the furnace feed bin without cooling, screening, crushing, conveying, or storing. In this process agglomerates are preheated and less electrical energy is required for smelting. Part of the energy for indurating the agglomerates is recovered as electric energy. However, agglomerates can be indurated at a temperature of 500° F., or higher, to assure that the temperature of the feed mixture is greater than the dewpoint of elemental phosphorus, provided the high-temperature induration is needed. The ore, flux, and reducing carbon are discharged into a combination blender and feed bin to assure that matched sizes of materials enter the furnace.

Another disclosure of the present invention is a new process for treating the gas at phosphorus furnaces. The gas leaving the furnace is subjected to adiabatic cooling in accordance with the normal process wherein the temperature is reduced to 145° F. and it becomes saturated with water. About 99 percent of the phosphorus in the gas is condensed. The gas is further cooled to about 127° F. in a tubular condenser to condense about 0.4 percent of the phosphorus originally present in the gas. Finally, the gases are cooled to about 80° F. by contact with chilled water for further collection of phosphorus by condensation.

The cleaned gases can be scrubbed with nitric acid to remove the last traces of phosphorus and sulfur followed by a final scrubbing with an alkaline scrubbing medium to decompose and absorb any phosphine that may be present. An alternative cleaning process involves scrubbing the gas with concentrated sulfuric acid to remove the last traces of phosphorus, and this must be followed by alkaline scrubbing to remove sulfur and phosphine. The treated gas is suitable for use in the air heater shown in FIG. 4 wherein the ratio of combustible gas to air is controlled to provide an oxygen-free flue gas having the following analysis in percent by volume.

$N_2$—65.7
$CO_2$—30.2
$H_2O$—4.1

Addition of the oxygen-free gas to the feed chutes and feed bin prevents air from being drawn into the furnace and prevents furnace gas from escaping from the furnace.

FIG. 89 in the publication, "Production of Elemental Phosphorus by the Electric-Furnace Method," R. B. Burt and J. C. Barber, Tennessee Valley Authority, Muscle Shoals, Ala. 35660, 1952, is a diagram of a heater used to heat the combustible gas at phosphorus furnaces. However, the gas was not amenable to combustion control which would permit making an oxygen-free flue gas. The hot air is used to indurate agglomerates on a wire mesh belt.

A process is disclosed for drying agglomerates with hot air. The air heated by means of apparatus shown in FIG. 4 can be used as a heating medium to dry agglomerates on a wire mesh belt.

A process is disclosed wherein the combustible gas made as a byproduct in submerged arc electric furnaces is cleaned and utilized in a cogeneration facility to generate electric energy.

PRIOR ART

A search of the prior art discloses the following publications and United States patents.

"Material Segregation Problem Experiences in the Production of Elemental Phosphorus," J. Kirk Sullivan, Proceedings of Electric Furnace Conference, Vol. 25, pages 83–85, Chicago, Ill. 1967.

"Energy Conservation and Pollution Abatement at Phosphorus Furnaces," James C. Barber, Environmental and Economic Considerations in Energy Utilization, Proceedings of the Seventh National Conference on Energy and the Environment, Nov. 30-Dec. 3, 1980, Phoenix, Ariz.

U.S. Pat. No. 2,040,081, Mar. 12, 1936, Harry A. Curtis. A process is disclosed for the agglomeration of finely ground phosphate in a pug mill.

U.S. Pat. No. 3,034,883, May 15, 1962, T. P. Hignett, Alvin B. Phillips and Ronald D. Young. A process is disclosed for the agglomeration of a fertilizer mixture where superphosphate is produced in place in the binder.

U.S. Pat. No. 3,202,744, Aug. 24, 1965, J. C. Barber, George H. Megar and Thomas S. Sloan. Phosphorus sludge is used as a binder to briquet phosphorus furnace feed.

U.S. Pat. No. 3,335,094, Aug. 8, 1967, W. J. Darby. This is a process for preparing a briquetted mixture of phosphate, silica, and coke having a high electrical resistance.

U.S. Pat. No. 3,531,250, Sept. 29, 1970. Arnulf Hinz, Heinz Harnish, and Hans Werner Aiegler. A process is disclosed for utilizing phosphorus sludge to make elemental phosphorus. The sludge is mixed with phosphate rock and the mixture is dried and agglomerated by any of the usual methods.

U.S. Pat. No. 3,852,050, Dec. 3, 1974, Chao Hsiao and L. B. Horton. Solids-free gas containing phosphorus, carbon monoxide and water from an electric reduction furnace is passed upward through a primary condenser where the gas is contacted countercurrently with a water spray at about 60° C. to condense a portion of the phosphorus as a liquid. The resulting mixture of water and liquid phosphorus is passed to a settling zone for recovery of the phosphorus. Effluent gas from the primary condenser is then passed upward through a secondary condenser in which water at 4° C. is sprayed countercurrently down the center to quench rapidly the remaining phosphorus vapor into solid particles containing entrapped water. The resulting slurry of solid phosphorus in water is fed to the settling zone for recovery as molten phosphorus.

U.S. Pat. No. 2,267,077, Dec. 23, 1941, George W. Burke. Dense, hard cakes of phosphorus sludge are formed. The cakes are subjected to heat to vaporize the phosphorus.

U.S. Pat. No. 4,372,929, Feb. 8, 1983, James C. Barber. A process is disclosed for agglomerating discrete particles of phosphate ore. A mineral acid, an alkaline fluid and water are added to the phosphate ore and the mixture is tumbled to form agglomerates. The agglomerates are indurated by heating at a temperature in the range of 120° to 150° C.

U.S. Pat. No. 4,373,893, Feb. 15, 1983. James C. Barber. A bench-scale apparatus is described for agglomerating discrete particles. A mineral acid, an alkaline fluid and water are tumbled in the bench-scale apparatus to form the agglomerates.

U.S. Pat. No. 4,421,521, Dec. 20, 1983, James C. Barber. A process is disclosed for agglomerating carbon particles for use as a reducing carbon in phosphorus furnaces. A mineral acid, an alkaline fluid and water are tumbled in a rotating cylinder to form agglomerates. The agglomerates are indurated by heating in the temperature range of 120° to 150° C.

U.S. Pat. No. 3,076,248, Feb. 5, 1963, Wendell L. Darrow and Joseph W. Kass. Phosphate agglomerates are prepared and said agglomerates are heated for 15 to 25 minutes in the temperature range of 2250° to 2500° F.

U.S. Pat. No. 3,760,048, Sept. 18, 1973, James K. Sullivan and Richard I. Howard. A method is disclosed for producing calcined agglomerates having high structural strength from western phosphate shale ore. The ore is crushed and agglomerated by briquetting. The green agglomerates are dried on a nonagitated grate and calcined for 15 minutes in the temperature range of 2000° to 2500° F.

U.S. Pat. No. 3,522,338, July 28, 1970, Theodore E. Kass and Robert J. Gleason. Granular calcium phosphate ore containing silica sand is agglomerated by the hot briquetting process. The mixture is calcined in the temperature range of 1400° to 1900° F. and the hot mixture is briquetted.

DESCRIPTION OF THE DRAWINGS

Four figures are included to aid in understanding the invention.

The section of power chart on the right indicated by 2 is from operation with a feed mixture having matched sizes of components. Unbeneficiated phosphate ore was the phosphate source and it had a $SiO_2$:CaO weight ratio of about 0.85. The feed mixture consisted of briquetted phosphate ore which had been calcined and lump coke. No silica rock was added. As shown by the chart, the powerload held steady when the components of the feed mixture had matched sizes.

Figure 2:
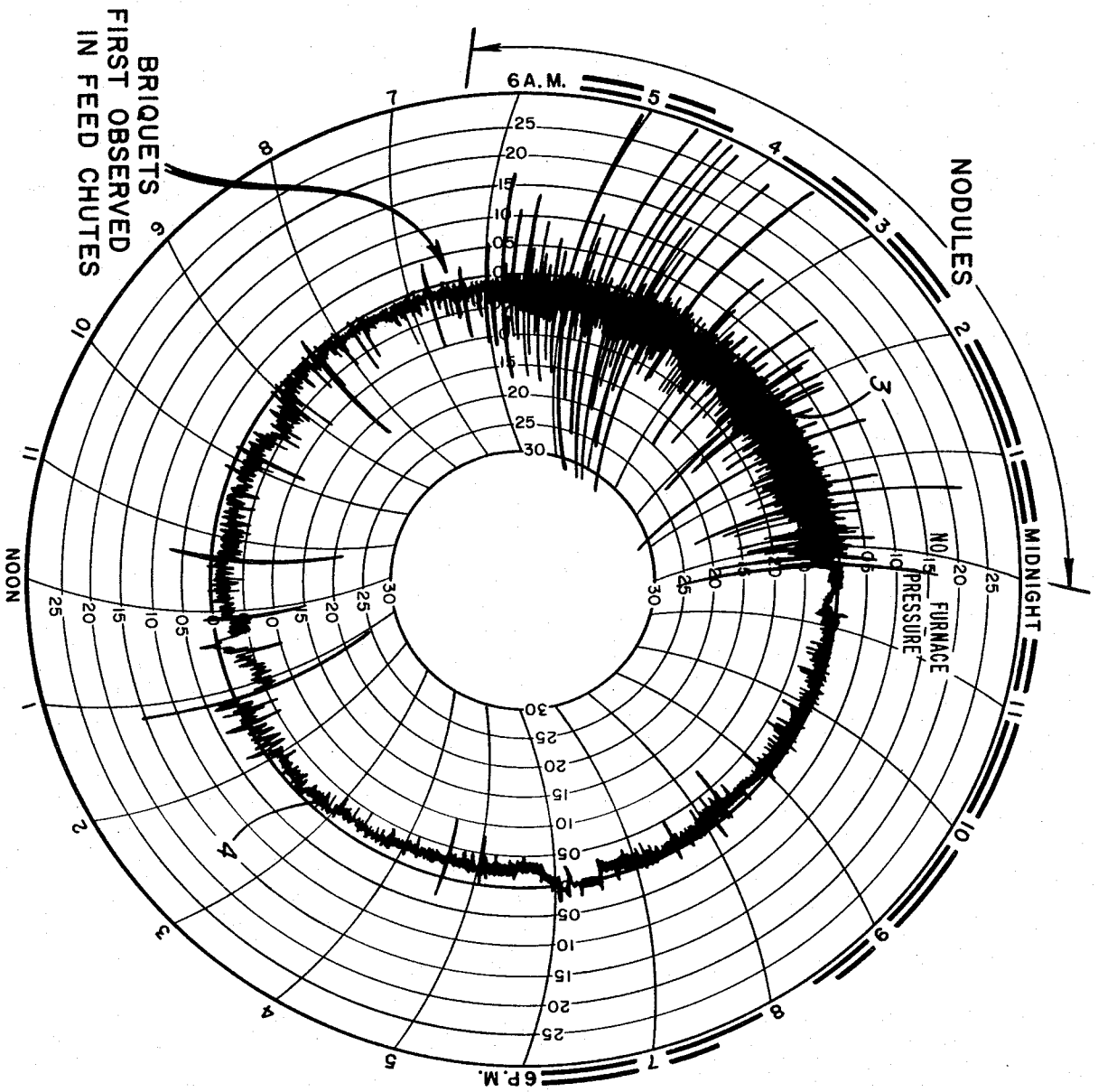

FIG. 2 is a pressure chart for the phosphorus furnace at the beginning of the test with the regular feed mixture. The units on the chart are plus or minus inches of water. The section of chart indicated as 3 from midnight to 6:00 a.m. is with the normal feed mixture with unmatched size of components. The section of chart indicated as 4 between 6:00 a.m. and midnight is with the feed mixture having matched size of components. The furnace pressure was much steadier with matched sizes of components in the feed mixture.

Figure 3:
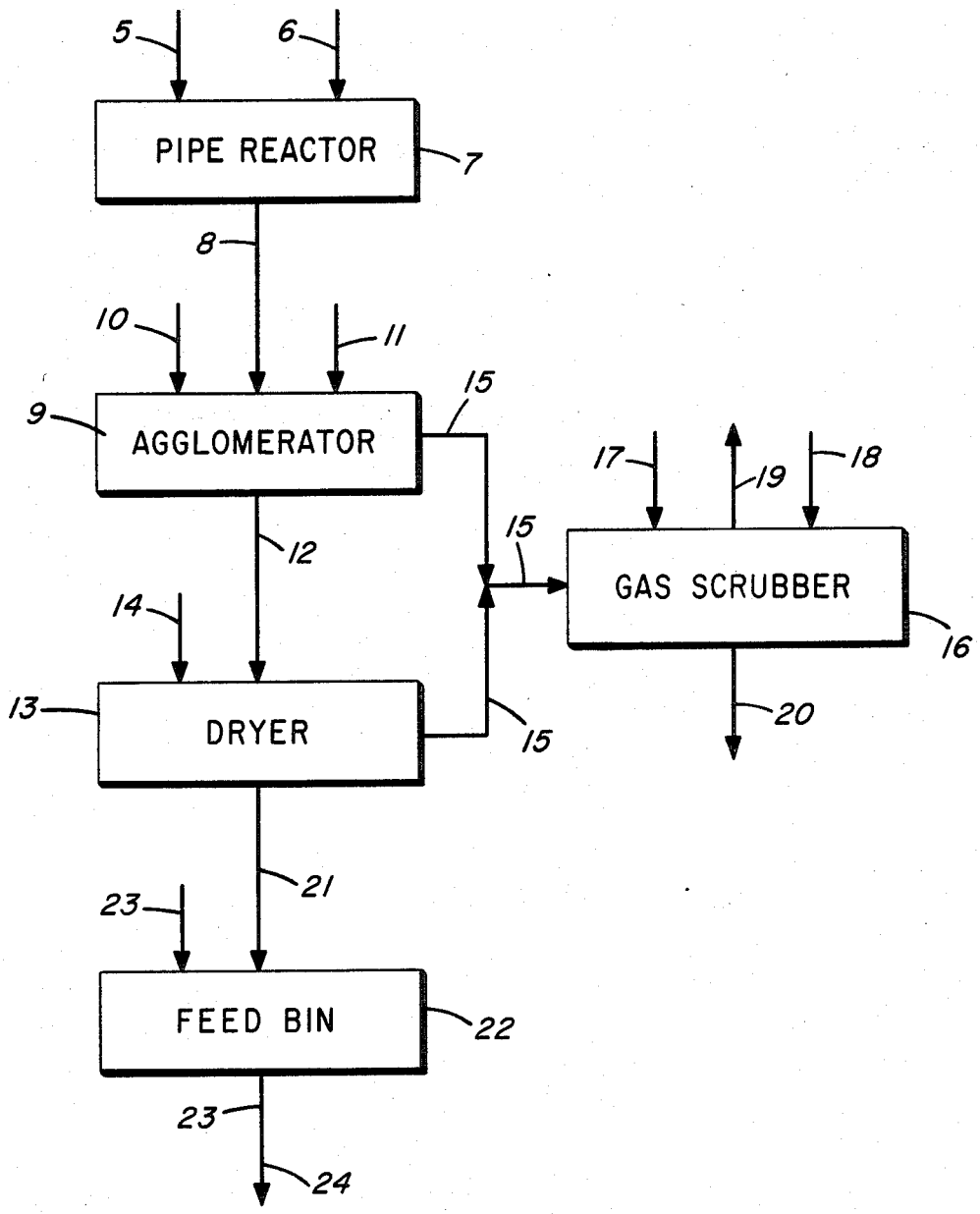

FIG. 3 is a diagram of the process for agglomerating the furnace feed materials. Ground phosphate 5 and phosphoric acid 6 are fed into pipe reactor 7. Reacted product 8 is discharged into agglomerator 9; phosphate ore 10 and flotation tailings 11 are fed into agglomerator 9. Agglomerates 12 discharge into dryer 13. Heat for dryer is supplied as hot air 14. Exhaust gases from agglomerator 9 and dryer 13 flow through lines 15 and are treated in gas scrubber 16. The scrubbing medium is condenser water 17 and ammonium hydroxide 18 is added to maintain the pH in the range of 5.5 to 6.0. Cleaned gas 19 is exhausted to the atmosphere. Condenser water 17 is recirculated at gas scrubber 16 and part of the recirculating stream indicated as 20 is bled off and returned to the phosphorus condensing system. Dried agglomerates 21 discharge into furnace feed bin 22. Agglomerates and reducing carbon not shown in FIG. 3 flow through chutes 24 into phosphorus furnace not shown in FIG. 3. Oxygen-free gas 23 is put in feed bin 22 and feed chutes 24.

Figure 4:
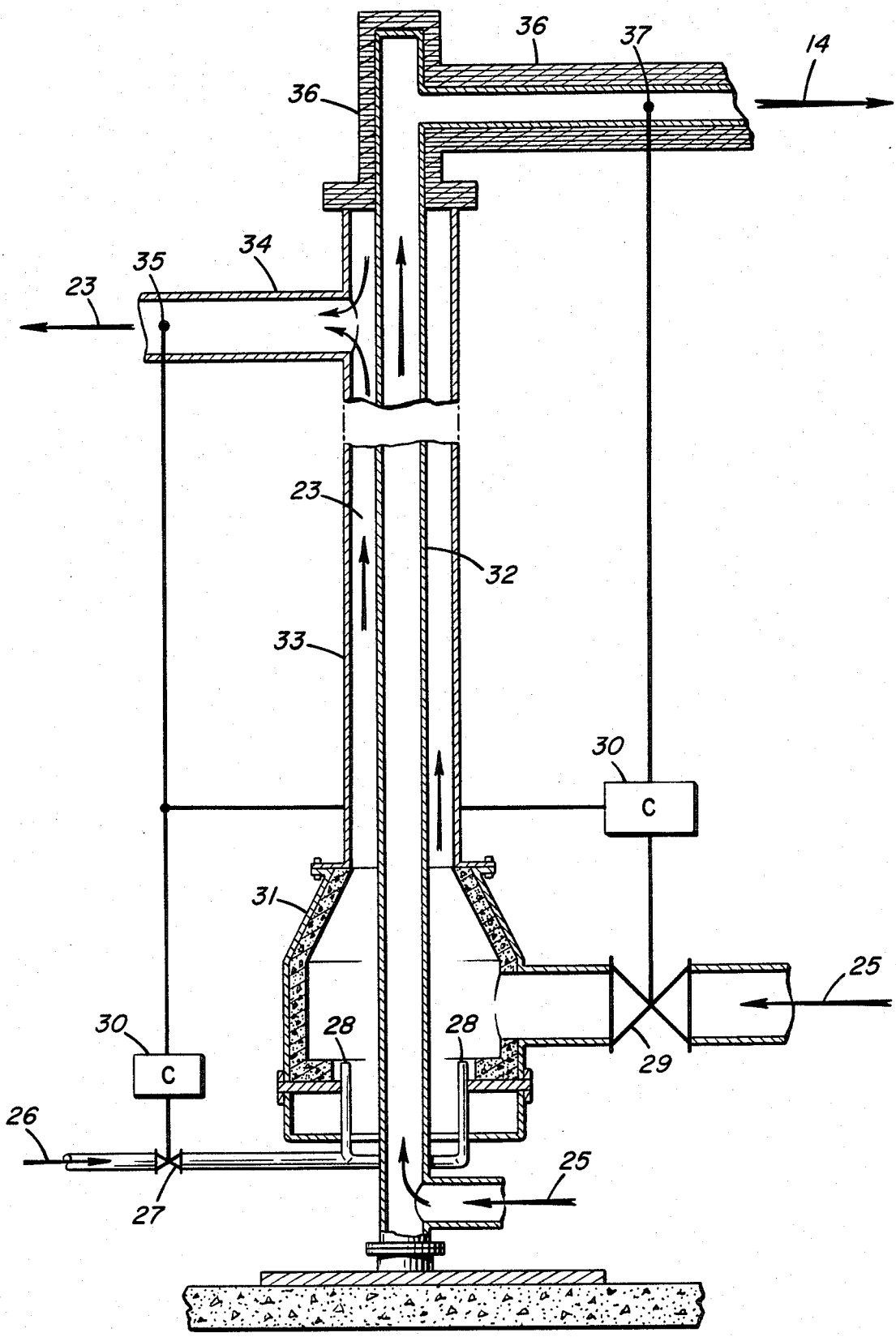

FIG. 4 is air heater used to heat air 14 added to dryer 13 in FIG. 3. Air indicated as 25 is supplied by blower not shown in FIG. 4. Air flows upward through vertical pipe 32. Combustible gas 26 flows through control valve 27 to burners 28. Combustion air 25 is supplied by a blower not shown in FIG. 4. Combustion air flows through control valve 29 to combustion chamber 31. Hot gases from combustion chamber 31 flow upward through concentric space between pipes 32 and 33. Heat is transferred from hot combustion gases to air 25 flowing through pipe 32. The top part of air heater assembly is insulated by insulation 36. Heated air 14 flows to dryer to supply heat for drying agglomerates as shown in FIG. 3. Temperature of heated air is measured by sensing element 37 and quantity of combustible gas is controlled by controls 30 and control valve 27. Oxygen content of combustion gas is determined by sensing element 35 which operates through controller 30 and control valves 27 and 29 to make oxygen-free combustion gas 23. Oxygen-free gas 22 is added to feed bin 22 and chutes 24 in FIG. 3.

OBJECTS OF THE INVENTION

A major objective of the present invention is to conserve energy during the smelting of phosphate ores. It has been explained that with equal sizes of the components of the furnace feed materials electric energy consumption is reduced. FIG. 3 illustrates a process for preparing the matched sizes of feed materials. A similar process will reduce the electric energy requirements at submerged arc electric furnaces smelting metallurgical ores. The discovery is applicable for the preparation of matched sizes of feed materials for metallurgical furnaces, and a further objective is to conserve energy by the preparation of matched sizes of feed materials at metallurgical furnaces. However, binders for the agglomeration of the metallurgical ores have not been identified.

Another object is to conserve energy by the cogeneration of electricity at plants producing elemental phosphorus. About 80,500 cubic feet (STP) of combustible gas is made per ton of phosphorus produced. The gas has a heat of combustion in the range of "medium Btu gas" with reference to coal gasification processes. When the gas is burned, about 27.6 million Btu of heat is released per ton of phosphorus produced. This is equal to 34 percent of the total energy input for smelting phosphate ores and 65 percent of the electric energy input at the furnaces. Therefore, a large proportion of the electric energy input can be recovered in a cogeneration facility provided the combustible gas can be successfully utilized. Heretofore, the combustible gas has not been suitable for use in a cogeneration facility because the impurities corrode the combustion equipment. The damaging impurities can be removed by the processes disclosed in the invention. Combustible gases are generated when metallurgical ores are smelted, and an object of the invention is cogeneration of electric energy at plants smelting metallurgical ores.

Another object is to provide a process for smelting unbeneficiated phosphate ores to make elemental phosphorus. Beneficiation of the ores is costly, and consumes energy to operate the equipment. Solid wastes are made and much of the $P_2O_5$ values in the ore are lost in these wastes. A further object is to conserve phosphate ore deposits by using chemical processes which do not require beneficiation.

Background information on phosphate technology may be needed to explain how the phosphate ores can be conserved.

The source of phosphorus is a mineral in phosphate ores called fluorapatite. Fluorapatite has the nominal chemical formula $Ca_{10}(PO_4)_6F_2$. A calculation shows that the theoretical $P_2O_5$ content of the mineral is 42.2 percent, but about 40 percent may be typical for the mineral found in the U.S. Fluorapatite usually occurs in a modified form wherein carbonate and fluoride replace the $PO_4$ radical, and some of the calcium is replaced by other metals. The degree of this substitution varies from one ore deposit to another, and the $P_2O_5$ content of the mineral is not constant. The $P_2O_5$ content of the mineral is not increased by beneficiation of the ores.

Phosphate ores contain various other minerals present as discrete particles in ore deposits. Silica is a major constituent which may be present as particles of quartz and as particles of silicates. The proportion of these nonphosphorus minerals in the ores is increasing at areas where the ore deposits have been mined for a long time. The rich ores were mined first and the remaining ores may contain more nonphosphorus minerals than fluorapatite. In other areas, rich deposits remain.

About 85 percent of the elemental phosphorus produced by smelting phosphate ores is converted into phosphoric acid called thermal phosphoric acid. Phosphoric acid is made by another method wherein ores are digested with sulfuric acid and the resulting slurry is filtered to recover the acid as filtrate. This is called the wet-process method of making the acid. In the U.S. the quantity of wet-process acid made is over four times as much as the quantity of thermal acid. It is impractical to use unbeneficiated ore in the wet process because excessive amounts of sulfuric acid would be consumed to digest the nonphosphorus minerals. The fluorapatite mineral is separated from the nonphosphorus minerals to beneficiate the ore and prevent excessive consumption of sulfuric acid. The process consists of washing the ores with water to remove as much of the clayey minerals as possible. A solid waste called slimes is obtained. Unfortunately, particles of fluorapatite are washed out and the slimes contain about 9 percent $P_2O_5$. Storage of slimes in ponds causes environmental problems as well as loss of $P_2O_5$ values.

Further beneficiation of phosphate ore by flotation yields flotation concentrate which contains 31 to 34 percent $P_2O_5$, but it is obvious from the analyses that a significant amount of nonphosphorus minerals remain in the ore after flotation. Nevertheless, upgrading by flotation is considered essential for production of wet-process phosphoric acid. The main purpose of flotation is to separate silica from fluorapatite. A solid waste is obtained called flotation tailings, and it contains about 4 percent $P_2O_5$ and 90 percent $SiO_2$.

Phosphate ores have been mined in central Florida for a long time and the richer deposits in this area have been depleted. Wet-process phosphoric acid production is concentrated in this area. Phosphorus furnaces are located in middle Tennessee and the Western States. The ore used in the middle Tennessee furnaces is beneficiated by washing; ore used in the western furnaces is unbeneficiated.

A product is obtained by washing ore from central Florida called Florida pebble. The beneficiated ore contains 31 to 32 percent $P_2O_5$ and it has an average particle size of 0.19-inch. The particles are too small to use in phosphorus furnaces without agglomeration. When Florida pebble was agglomerated by nodulizing the average size of the particles was 0.62-inch, and the nodules provided an excellent feed for phosphorus furnaces. Unfortunately, Florida pebble is unsuited for high-temperature agglomeration. Kiln lining is excessively eroded during nodulizing and the ore contains no binder.

An object of the invention is to agglomerate phosphate ore which has been beneficiated by washing. In a practical application, Florida pebble phosphate can be agglomerated by low-temperature processes and shipped to phosphorus producers in middle Tennessee for smelting. Binder for agglomeration of the Florida pebble can be prepared from wet-process phosphoric acid sludge and flotation concentrate ground for use in making the acid.

Another object is to agglomerate high-silica-content wastes by low-temperature agglomeration processes. The waste may be utilized as a source of silica for the production of elemental phosphorus. A specific waste identified for use in this manner is flotation tailings.

The feeding of unbeneficiated phosphate ores in phosphorus furnaces has the potential for substantially reducing the cost of producing elemental phosphorus. Clay minerals in the ores melt at lower temperatures than does fluorapatite, and the ores can be nodulized at lower temperatures than beneficiated ores. When the ores are preformed followed by induration at high temperatures the clay serves as binder. But the ores must have a minimum $P_2O_5$ content in the range of 24 to 25 percent in order for phosphorus furnaces to perform satisfactorily.

Larger than normal proportions of silica rock are added to improve operation with unbeneficiated phosphate. The $SiO_2$:CaO weight ratio may be increased to 0.95 to 1.00, whereas a ratio of 0.85 is adequate for beneficiated ores. The higher $SiO_2$:CaO ratios increase the quantity of slag produced and the heat lost in molten slag. Electric energy consumption is increased with greater proportions of silica in the feed mixture.

Some phosphate ores occur as consolidated masses which are not amenable to beneficiation by washing and flotation. Silicates cement the fluorapatite mineral into a solid mass. The rock-like ores can be used as phosphorus furnace feeds when they are crushed and screened to obtain the appropriate size. However, fines are formed during crushing and screening. An object of the invention is to provide a low-temperature process for the agglomeration of the fines.

A further object is to provide a process for making phosphoric acid with low impurities content from highly contaminated phosphoric acid. For example, phosphoric acid sludge precipitated from merchant-grade wet-process acid can be used as item 6 in FIG. 3. The sludge acid has a F:$P_2O_5$ weight ratio of about 0.05. When the sludge acid is smelted in the phosphorus furnace, elemental phosphorus is produced. The phosphorus can be processed into phosphoric acid having a F:$P_2O_5$ weight ratio in the range of 0.000120 to 0.000140.

Another object is to smelt biomass wherein carbon in the biomass is reducing carbon for the reduction of phosphate ores.

In order for those skilled in the art to better understand how the present invention can be practiced, the following examples are given by way of illustration, but not necessarily by way of limitation.

EXAMPLE I

Phosphorus furnaces were operated with two types of lump phosphate ores mined in middle Tennessee. One of the phosphates was plate brown rock and the other was washer rock. Both ores occurred in lump form in ore deposits, but the washer rock was associated with matrix. Washer rock was recovered when the matrix was beneficiated by washing. Table 2 gives the chemical analyses of the two phosphates.

TABLE 2

| Analysis of Lump Phosphate Ores | Percent $P_2O_5$ | |
|---|---|---|
| | Plate brown rock | Washer brown rock |
| Moisture | 2.2 | 1.3 |
| $P_2O_5$ | 32.8 | 31.4 |
| CaO | 46.8 | 44.0 |
| $SiO_2$ | 7.8 | 13.1 |
| $Fe_2O_3$ | 3.3 | 2.7 |
| $Al_2O_3$ | 2.5 | 0.6 |
| F | 3.5 | 3.5 |
| $CO_2$ | 1.6 | 1.3 |
| S | 0.3 | 0.2 |

Tests were made in pilot plants and in production units to determine whether or not the naturally-occurring lump phosphate ores were suitable for use as feed materials in phosphorus furnaces. Some of the lump phosphates, such as Tennessee blue rock, became sticky and obstructed the flow of furnace gases through the feed materials. Plate brown rock and washer brown rock caused no obstructions to gas flow and they were successfully used to produce phosphorus. However, tests showed that the phosphate ores should meet certain size specifications for satisfactory use in the furnace. Material which passed a 2-inch screen and was retained on a 4- to 6-mesh screen was considered a satisfactory size.

Table 3 gives data on the operation of a 5,000-kW phosphorus furnace with plate brown rock and washer brown rock.

TABLE 3

| Phosphorous Furnace Operating Data with Uncalcined Lump Phosphate Ore | Plate brown rock | Washer brown rock |
|---|---|---|
| Average particle size, inches | 1.18 | 0.86 |
| $P_2O_5$ in phosphate plus silica, percent | 25.2 | 25.4 |
| $SiO_2$:CaO weight ratio in feed materials | 0.82 | 0.85 |
| Coke fed, percent of theoretical requirement | 101 | 103 |
| Powerload, kilowatts | 5550 | 5210 |
| Electric energy requirement: | | |
| Kilowatt-hours per ton of $P_2O_5$ fed | 5320 | 5130 |
| Kilowatt-hours per ton of $P_2O_5$ volatilized | 6075 | 5685 |
| Furnace gas temperature, °F. | 965 | 1072 |
| $P_2O_5$ in slag, percent | 2.0 | 1.6 |

The data in table 3 show that improvement in furnace performance was needed. A relatively large amount of electric energy was required for smelting, furnace gas temperatures were too high, and too much $P_2O_5$ was lost in the slag. Nevertheless, naturally-occurring lump phosphate ores can be used to produce phosphorus without calcining the ores.

EXAMPLE II

The quantity of lump phosphate ore available in the middle Tennessee deposits was inadequate to meet the requirements for a commercial plant. An agglomeration process was developed to form lump material from small sized phosphate ore.

The small sized phosphate was agglomerated by nodulizing. A description of the nodulizing process and data on development of the process are given in the publication, "Agglomeration of Phosphate for Furnace Use," Chemical Engineering Report No. 4, Tennessee Valley Authority, National Fertilizer Development Center, Muscle Shoals, Ala. 35660, 1950.

Analyses of nodules prepared from two deposits—Tennessee and Florida—are given in table 4. The Tennessee ore had been beneficiated by washing, and the ore beneficiated in this manner is called Tennessee sand. The Florida ore was also beneficiated by washing, and it was called Florida pebble.

TABLE 4

| Constituent | Analyses of Nodules: Nodules prepared from Tennessee sand | Nodules prepared from Florida pebble |
|---|---|---|
| Chemical analysis, percent | | |
| $P_2O_5$ | 29.7 | 32.8 |
| $SiO_2$ | 18.8 | 12.7 |
| CaO | 41.7 | 48.6 |
| $Fe_2O_3$ | 3.6 | 1.4 |
| F | 2.3 | 3.0 |
| Screen analysis, percent | | |
| +1 inch | 25.4 | 13.0 |
| −1 + ½ inch | 29.9 | 29.5 |
| −½ + 1¼ inch | 21.3 | 29.0 |
| −¼ inch | 13.4 | 28.5 |
| Average particle size, inch | 0.84 | 0.62 |
| Size stability[a] | 0.79 | 0.66 |

[a]Size stability is a measure of the resistance to crushing. Size stability is the ratio of average particle size after being dropped six times from a height of 6 feet to the average particle size before being dropped.

Tests were made at phosphorus furnaces with nodulized phosphate. Table 5 gives results of the tests.

TABLE 5

| Phosphorus Furnace Operating Data with Nodulized Phosphate as Feed | Nodules prepared from Tennessee sand | Nodules prepared from Florida pebble |
|---|---|---|
| Powerload, kilowatts | 8600 | 8700 |
| Voltage, phase | 260 | 260 |
| Coke fed, percent of theoretical requirement | 101 | 102 |
| $P_2O_5$ in phosphate plus silica, percent | 25.8 | 25.4 |
| $SiO_2$:CaO weight ratio | 0.80 | 0.83 |
| Furnace gas temperature, °F. | 660 | 510 |
| $P_2O_5$ content of slag, percent | 1.1 | 1.3 |
| Electrical energy requirement: | | |
| Kilowatt-hours per ton of $P_2O_5$ charged | 4740 | 4590 |
| Kilowatt-hours per ton of $P_2O_5$ volatilized | 5160 | 4930 |

The data in table 5 show that the furnace gas temperature was 150° F. lower with nodules prepared from beneficiated Florida ore than with beneficiated Tennessee ore. Also, electrical energy consumption was 3 to 4 percent lower with the Florida ore. This improved furnace performance was attributed to higher $P_2O_5$ content of the Florida ore. Nodules prepared from Florida pebble contained about 10 percent more $P_2O_5$ than nodules prepared from Tennessee sand, as shown in table 4. Wear on the kiln lining was excessive when Florida pebble was agglomerated by nodulizing. The temperatures required to nodulize Florida pebble were greater than the temperatures required for Tennessee sand, and the excessive wear on the kiln lining was attributed to the higher temperatures. The refractory chemically reacted with the phosphate ore and $P_2O_5$ diffused into the refractory causing spalling.

The performance of the furnaces with nodules was significantly better than it was with the uncalcined lump rock.

EXAMPLE III

Mixtures of uncalcined Florida pebble and nodulized Tennessee sand were smelted in a phosphorus furnace operating at a powerload of about 8750 kW. The nodules had a chemical composition and screen analysis as given in table 4. Chemical composition and screen analyses of the Florida pebble are given in table 6.

TABLE 6

| Chemical and Screen Analysis of Florida Pebble | |
|---|---|
| Chemical analysis | |
| Constituent | Percent on dry basis |
| $P_2O_5$ | 31.4 |
| CaO | 47.5 |
| $SiO_2$ | 9.0 |
| $Al_2O_3$ | 1.0 |
| $Fe_2O_3$ | 1.7 |
| Screen analysis | |
| Screen opening | Percent on screen |
| 1 inch | 0.0 |
| ½inch | 4.6 |
| ¼inch | 14.3 |
| 10 mesh | 62.6 |

Average size of the Florida pebble was about 0.2-inch. Screen analyses showed that 81.1 percent was smaller than ¼-inch and 18.5 percent was smaller than 10 mesh.

The proportion of uncalcined Florida pebble in the feed mixture was increased by increments, but phosphorus furnace operations were adversely affected by increasing the proportion in the mixture. The gas temperatures and pressure fluctuations increased. Also, the pebble caused the electric energy consumption to increase, which was attributed to inefficient exchange of heat between the furnace gas and feed materials and to loss of phosphorus by the inleakage of air. A feed mixture containing about 45 percent pebble was the approximate maximum that could be tolerated in the mixture without causing hazardous operating conditions. However, a mixture containing about 20 percent pebble was smelted without much difficulty.

Uncalcined Florida pebble was not a satisfactory feed for phosphorus furnaces because of its small size. Much of the fine material became entrained in the furnace gas and was deposited in the furnace precipitator and in the condenser water. These unreduced particles of phosphate ore contaminate the condenser water resulting in larger water bleedoff rates. The segregation problem was made worse by the large amount of fines in the phosphate ore. Segregation caused severe channeling through the feed mixture, and entrainment of the fine particles was more severe than it would be without segregation.

EXAMPLE IV

Mixtures of uncalcined Florida hard rock and nodulized Tennessee sand were smelted in a phosphorus furnace operating at a powerload of about 8570 kW. As in example III, the chemical and screen analyses of the nodules were about as given in table 4. Table 7 gives the chemical and screen analyses of Florida hard rock.

TABLE 7

Chemical and Screen Analysis of Florida Hard Rock

| Chemical analysis | |
|---|---|
| Constituent | Percent on dry basis |
| $P_2O_5$ | 36.2 |
| CaO | 52.1 |
| $SiO_2$ | 2.8 |
| $Al_2O_3$ | 0.8 |
| $Fe_2O_3$ | 1.0 |
| **Screen analysis** | |
| Screen opening | Percent on screen |
| 2 inch | 0.0 |
| 1 inch | 20.3 |
| ½inch | 35.2 |
| ¼inch | 19.7 |
| 10 mesh | 16.0 |

Florida hard rock occurs as a redeposited mineral and is found as plates, sheets, and other forms, but the material smelted was in lump form having an average particle size of 0.67-inch. About one-fourth of the material was smaller than ¼-inch, and 8 percent was less than 10 mesh. Laboratory tests showed that 35 to 40 percent of the material decrepitated into minus ¼-inch fines when the material was heated to 2200° F., but much less decrepitation occurred at 1000° F.

Florida hard rock had very little adverse effect on furnace operation up to 60 percent hard rock in the mixture. But larger percentages caused the pressure fluctuations to be greater and the furnace gas temperatures were higher than they ordinarily are with nodulized phosphate; however, operation was generally considered satisfactory, even when all the phosphate used was Florida hard rock.

The improved operation over that obtained with uncalcined Florida pebble—nodule mixtures was attributed to lower percentage of fines in the Florida hard rock. Segregation of the charge mixture was less with the Florida hard rock—nodule mixture; less unreduced phosphate was entrained in the gas stream with Florida pebble. The furnace could have been operated indefinitely with Florida hard rock as feed material but operation with Florida pebble was considered hazardous. The supply of Florida hard rock was inadequate for use in the production of phosphorus.

Overall conclusions drawn from phosphorus furnace tests with various phosphate feed materials are as follows.

1. Phosphate ores may be smelted without calcination to crystallize the fluorapatite mineral. This conclusion was verified by results of small-scale tests.

2. Phosphorus furnace operation is improved by decreasing the percentage of ¼-inch fines in the feed materials.

3. High percentage of $P_2O_5$ in the phosphate feed material, such as 36 percent in Florida hard rock, improves furnace operation. Technology is unavailable to beneficiate ore deposits to obtain phosphate containing as much as 36 percent $P_2O_5$.

EXAMPLE V

In accordance with one process for treating phosphate ore the unbeneficiated material, or matrix as it is commonly called, is agglomerated by briquetting, pelletizing, or pressing into compacted material. Clay in the matrix serves as binder in making the agglomerates. The agglomerates must be indurated in a nonagitated heating device to prepare material suitable for feeding into phosphorus furnaces.

Matrix from middle Tennessee phosphate deposits was agglomerated by briquetting and indurated by calcining in a shaft kiln to a temperature just above that required to crystallize fluorapatite. Material flows through a shaft kiln by gravity without agitation, and breakage does not occur. In a rotary kiln material is continually agitated by tumbling, and much breakage occurs.

A test was made in a phosphorus furnace with briquets which had been indurated in a shaft kiln. The powerload on the furnace was 8750 kW. Chemical and screen analyses of the matrix fed to the furnace are given in table 8.

TABLE 8

Chemical and Screen Analysis of Briquets Calcined in a Shaft Kiln

| Chemical analysis | |
|---|---|
| Constituent | Percent on dry basis |
| $P_2O_5$ | 23.6 |
| CaO | 33.0 |
| $SiO_2$ | 21.6 |
| $Fe_2O_3$ | 5.1 |
| **Screen analysis** | |
| Screen opening | Percent on screen |
| 2 inch | 0.0 |
| 1 inch | 31.6 |
| ½inch | 31.6 |
| ⅜inch | 6.1 |
| ¼inch | 6.2 |
| 4 mesh | 3.7 |

TABLE 8-continued

| Chemical and Screen Analysis of Briquets Calcined in a Shaft Kiln | |
|---|---|
| 6 mesh | 2.9 |
| 10 mesh | 6.7 |

The average particle size of the calcined briquets was 0.78-inch, and this was 16 percent larger than the uncalcined Florida hard rock. The screen analysis showed that about one-fourth of the material was smaller than ¼-inch, and this was about the same as for the hard rock. The briquets had 11 percent minus 10-mesh material as compared with 8 percent for the hard rock.

Furnace operation was unsatisfactory when the calcined briquets were smelted. After two days' operation the furnace gas temperature reached 1500° F. indicating heat exchange between the furnace gas and feed materials was poor. The high temperatures cause rapid deterioration of the furnace roof and the phosphorus condensing system. It was necessary to reduce the powerload in order to continue operating the furnace, but high furnace gas temperatures continued. After about 14 days' operation, a hole appeared in the furnace shell above the carbon lining and the feeding of calcined briquets was discontinued.

The furnace pressure fluctuated widely as did the powerload when the uncalcined briquets were being fed. Losses of $P_2O_5$ in the slag were greater than normal.

Causes of unsatisfactory operation with unbeneficiated phosphate ore were obscure. It appeared that molten material formed at a higher level in the furnace than normal and this was attributed to the clay in the unbeneficiated ore. It is likely the electrical resistivity of the mixture in the furnace was decreased by the presence of clay causing electric energy to be released at a higher level.

EXAMPLE VI

Phosphate matrix from the middle Tennessee deposits was agglomerated by nodulizing. The chemical analysis of the matrix was about as shown in table 8. The percentage of clay was higher than it was in the washed ore and this decreased the nodulizing temperature.

Phosphorus furnace operation was unsatisfactory with the unbeneficiated phosphate ore. Furnace gas temperatures were too high and loss of phosphorus in slag increased. Beneficiated Florida phosphate containing about 32 percent $P_2O_5$ was mixed with the matrix and the mixture was agglomerated. The quantity of beneficiated ore used was sufficient to provide an agglomerated mixture containing about 25.5 percent $P_2O_5$. Upgrading the ore in this manner improved the furnace operation. When unbeneficiated phosphate ore was being used in the furnace, operation was improved by adding more silica rock. The $SiO_2$:CaO weight ratio was varied in accordance with the $P_2O_5$ content of phosphate mixture being fed to the furnace, as indicated below.

| $P_2O_5$ content of phosphate mixture, % | $SiO_2$:CaO weight ratio |
|---|---|
| 25.5 or lower | 0.90 |
| 25.6 to 26.5 | 0.88 |
| 26.6 and higher | 0.86 |

When the phosphate feed mixture was increased to 26.6 percent, or higher, the $SiO_2$:CaO weight ratio scheduled was slightly higher than that scheduled with beneficiated ore.

The phosphorus furnaces could be operated without much difficulty when the feed was upgraded to 25.5 percent $P_2O_5$, but further improvement could be obtained by upgrading to higher $P_2O_5$ contents. For example, upgrading the phosphate feed to 36 percent $P_2O_5$ was expected to result in significant improvement, based on operating experience with Florida hard rock.

EXAMPLE VII

Samples of the feed mixture were obtained to determine the variation in composition inside the furnace. The furnace sampled operated at a powerload of 8500 kW, but the furnace was shut down when samples were taken. Cylindrical segments of the feed mixture were removed by inserting a cylindrical iron sleeve through three pokeholes in the furnace roof. A special rake was used to remove loose samples.

The phosphate was matrix from the Tennessee deposits which had been agglomerated by nodulizing. The screen analysis of the nodules was about as given in table 4 and the average particle size was about 0.84-inch. The coke used in the furnace was separated into plus 6-mesh and minus 6-mesh fractions by screening. Ninety percent of the coke used was plus 6-mesh and 10 percent was minus 6-mesh fines. All the plus 6-mesh coke was smaller than 1 inch, and the average size of the coke was about 0.25-inch. The average size of the silica rock was about 1 inch and it contained a maximum of 5 percent fines.

Chemical analyses of the samples removed from the furnace are given in table 1. The carbon content of the samples varied from an excess of 1277 percent of that required to reduce the $P_2O_5$ to a 94 percent deficiency. Also, analyses showed wide variations in the $SiO_2$:CaO weight ratios. These analytical data demonstrated that segregation of the feed mixture inside the furnace is a serious operating problem. It was postulated that control of segregation would improve exchange of heat between the hot gas and feed materials. This would decrease the electric energy consumption. The huge excess of carbon in the bottom of the furnace was evidence that the small sized coke particles are ineffective for the reduction of phosphate ore. Agglomeration of the small sized coke would result in further energy savings. However, no practical processes are available for the agglomeration of carbonaceous materials.

EXAMPLE VIII

A test procedure was developed to determine how much segregation occurs when a mixture of solid materials is fed to a phosphorus furnace. A test apparatus was assembled which consisted of a sloping wooden chute 6 feet long with diverging sides. The width of the sloping chute at the top was 5 inches and it was 10 inches at the bottom. This divergence corresponded to the spreading-out of material flowing down a conical-shaped pile which had a radius of 11 feet at the base. The chute was rectangular in cross section and it had sides 12 inches high. The slope of the chute was about the same as the angle of repose of the furnace feed mixture, but the lower end could be raised to a horizontal position. This was done when samples were taken.

Well-mixed portions of the feed were introduced into a feed hopper at the upper end of the chute. Thin metal plates inserted through slots at 12-inch intervals in the bottom of the sloping chute provided means for separating the poured mixture into six portions.

Large particles and rounded particles tended to roll down the smooth bottom of the wooden chute, regardless of the segregation tendency. This action was minimized by prelining the bottom with a unit layer of the phosphate component. The layer of material was maintained by raising the metal divider slightly to maintain the layer and simulate the surface of a conical pile. The bottom layer was subtracted before computing segregation ratios. A gate in the bottom of the hopper was opened and the furnace feed mixture was allowed to flow down the sloping chute. When the tumbling material came to rest, the bottom end of the chute was raised to a horizontal position. The thin metal plates were pushed up through the slots to divide the poured material into six samples. The components in each sample were separated by hand and weighed.

The segregation tendency was expressed as the ratio of the original proportion of the principal component to its proportion in the segregated material.

Experiments with the device described above gave results which simulated the feeding of materials into the furnace through feed chutes, or in discharging material into a bin. It was possible to determine the segregating tendency of the furnace feed mixture without shutting down the furnace, removing samples through poke holes in the roof, and analyzing the samples.

EXAMPLE IX

Phosphate matrix from middle Tennessee was agglomerated by briquetting in a press having pillow-shaped pockets 1 11/16 inch by 1 11/16 inch by 1 inch thick. The briquets were calcined in a rotary kiln in the temperature range of 2100° to 2200° F. It was planned to prepare indurated agglomerates having an average particle size of about 1 inch, and much breakage of briquets was anticipated. Tumbling of the briquets during passage through the rotary kiln and handling of the agglomerates caused much breakage and fines. The indurated briquets were screened on a 1-inch screen and minus 1-inch material was rejected.

A special size of lump coke was purchased and it was expected this material would have an average particle size of 1 inch. The coke was larger than expected and it was crushed and screened in order to obtain the desired size.

The briquets were stored in a concrete bin; the coke was stored in another bin. The briquets and coke were sampled as they were discharged from the bins by feeders. Screen analyses and the average sizes of the two materials are given in table 9.

TABLE 9

| | Screen Analysis and Average Particle Sizes of Briquets and Coke | | | | | | |
|---|---|---|---|---|---|---|---|
| | Percent on screen, inches | | | | | | Avg. particle |
| Material | 1½ | 1¾ | 1¼ | 1 | ¾ | ½ | size, inches |
| Briquets | 5 | 9 | 12 | 29 | 31 | — | 1.018 |
| Coke | 0 | 6 | 18 | 33 | 27 | 11 | 1.011 |

A segregation test of a mixture of the two materials was made in accordance with the procedure described in example VIII. The proportions of phosphate ore and coke in the mixture were the same as the proportions that would be used as furnace feed. The "R index" was determined and this index is defined as follows.

R index = Weight ratio of major component to lesser component in unsegregated mixture divided by the weight ratio of major component to lesser component in segregated mixture The R index for the mixture of briquets and coke would be R index = Pounds of briquets in unsegregated mixture divided by pounds of coke in unsegregated mixture / Pounds of briquets in segregated mixture divided by pounds of coke in segregated mixture or $$\frac{\text{Pounds of briquets in unsegregated mixture}}{\text{Pounds of coke in unsegregated mixture}} \times \frac{\text{Pounds of coke in segregated mixture}}{\text{Pounds of briquets in segregated mixture}}$$

If no segregation occurs, the R index is unity; an index greater than unity shows that excess coke is in the segregated sample; and an index less than unity shows a deficiency of coke. Results of the segregation test made with the sloping chute are given in table 10.

TABLE 10

| Results of Segregation Tests Made with a Mixture of Briquets and Coke | | |
|---|---|---|
| Section of chute | R index | Deviation from unity, percent |
| 1[a] | 1.003 | 0.3 |
| 2 | 1.027 | 2.7 |
| 3 | 0.945 | 5.5 |
| 4 | 1.169 | 16.9 |
| 5 | 0.924 | 7.6 |
| 6[b] | 0.928 | 7.2 |

[a]Top section of chute.
[b]Bottom section of chute.

The fourth section of the chute was segregated much worse than the others and it is likely data for this section are not representative. The average deviation of the R index from unity was 4.7 percent omitting a deviation of 16.9 percent for section 4. Results of these segregation tests were taken as a measure of the tendency for segregation inside a furnace.

EXAMPLE X

The phosphate ore agglomerated in example IX was unbeneficiated. The $SiO_2$ contents of unbeneficiated ore varied widely. Carloads of the ore were selected which had a $SiO_2$:CaO weight ratio of approximately 0.85; consequently, no silica rock was needed when the ore was smelted. The carload lots selected contained $P_2O_5$ in the range of 23.5 to 24.5 percent $P_2O_5$.

The quantity of phosphate ore agglomerated was about 357 tons and this was adequate for the operation of a 9,000-kW phosphorus furnace for about 39 hours. It was necessary to prepare large size briquets and depend on breakage in calcining and handling to obtain particles in the size range suitable for furnace feeding.

Lump coke was purchased and sized to obtain material about the same size as the indurated briquets, as described in example IX. Table 9 gives the screen analyses of the briquets and coke, and table 10 gives the results of segregation tests.

Figure 1:
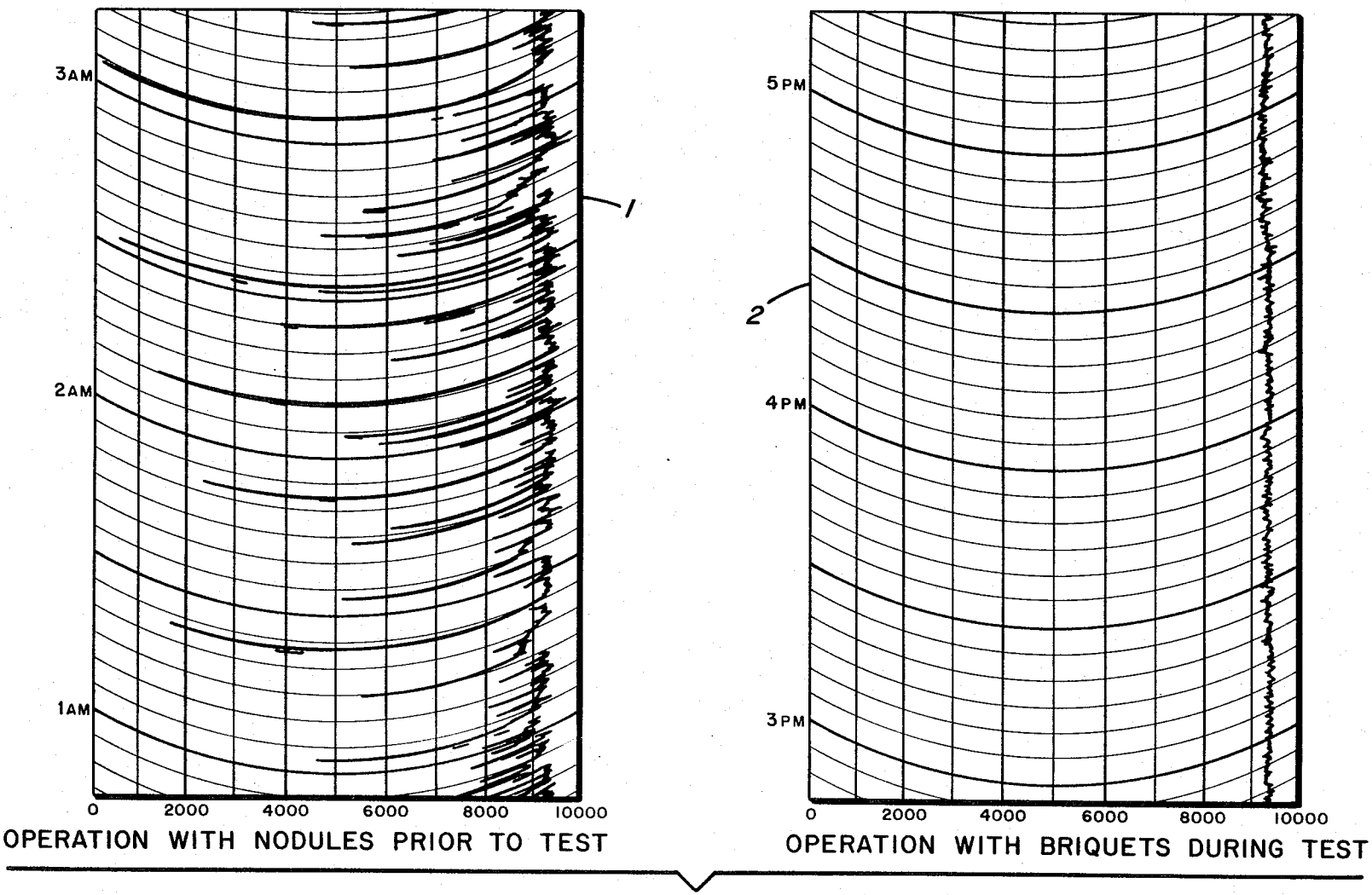
FIG. 1 shows sections of a power chart for a 9,900-kW phosphorus furnace. The normal feed material was a mixture of nodulized phosphate, silica rock, and metallurgical coke. The feed materials separated inside the furnace as shown by the analysis of samples taken by core drilling the charge. The section of power chart on the left indicated by 1 is typical of the operation with this mixture of feed materials. The powerload was unsteady with deep dips, two of which were almost zero. At 2:40 a.m. there was a dip and about 5 minutes' time was required to resume operation at full load. The dips in powerload represent loss of furnace capacity.

The mixture of briquets and coke was fed to the furnace and replaced a mixture of nodules, coke, and silica rock. Furnace operation was significantly improved because the particles in the briquet-coke mixture were much more closely matched than the particles in the nodules-coke-silica rock mixture. FIG. 1 shows sections of the power chart prior to the test and during the test. It is obvious that the powerload was much steadier with the more closely matched materials. This increased the capacity of the furnace.

FIG. 2 shows the decrease in pressure fluctuations when the more closely matched materials were fed. The decrease in pressure fluctuations indicates loss of phosphorus by inleakage of air is decreased. Analysis of the furnace gas for nitrogen showed that the inleakage of air was about 2.7 times greater with the unmatched feed materials than with the more closely matched materials. When air inleakage occurs, oxygen in the air oxidizes elemental phosphorus to form $P_2O_5$ and phosphorus is lost.

Recovery of heat from the furnace gases was significantly improved when the more closely matched feed materials were used. The furnace gas temperature was in the range of 450° to 460° F. with briquets, but the average temperature was about 660° F. with unmatched materials. This approximately 200° F. decrease in the furnace gas temperature was attributed to improved heat transfer, but decrease in the inleakage of air also decreases the gas temperature. Electric energy consumption decreased 16 percent when the change was made from the unmatched to the more closely matched materials. However, the test was too short for an accurate measurement of the electric energy consumption.

The phosphorus content of the slag increased when the more closely matched feed materials were used, thereby increasing phosphorus losses. Unbeneficiated phosphate ore was not as reactive as the mixture of unbeneficiated and beneficiated materials normally used. It was concluded that the minimum $P_2O_5$ content of the phosphate should be about 26 percent.

EXAMPLE XI

A gravity-flow mixing tower was tested to investigate the use of this device for the preparation of homogeneous mixtures of solid fertilizers. A description of the mixing tower is given in the publication, "TVA Bulk Blending Tower," by Frank P. Achorn and Robert S. Meline, Commercial Fertilizer and Plant Food Industry, May 1965.

A test was made to prepare 18-18-18 fertilizer by mixing granular high-analysis phosphate, diammonium phosphate, ammonium phosphate nitrate, and potassium chloride. Screen analyses of the materials are given in table 11.

TABLE 11

Screen Analysis of Fertilizer Materials

| Material | Cumulative percent retained on screen 6 | 10 | 12 | 14 | 16 | 20 |
|---|---|---|---|---|---|---|
| Granular high-analysis phosphate | 0 | 51.0 | 82.6 | 95.0 | 99.0 | 100.0 |
| Diammonium phosphate | 3.7 | 75.9 | 86.8 | 95.6 | 99.5 | 99.7 |
| Ammonium phosphate nitrate | 4.6 | 87.5 | 93.8 | 95.9 | 98.3 | 98.8 |
| Potassium chloride | 1.1 | 88.6 | 94.3 | 96.3 | 98.7 | 99.3 |

The quantities of materials needed to make 18-18-18 fertilizer were weighed into a weigh pan. The contents of the weigh pan were dumped into the boot of an elevator and the elevator conveyed the materials to a hopper at the top of a mixing tower. A gate at the bottom of the hopper was opened and the materials flowed by gravity through the mixing tower.

A 15-ton batch of fertilizer was mixed in the mixing tower and the mixture was bagged. Six hundred bags were filled. Six bags were taken at random and analyzed. Results of the analysis are given in table 12.

TABLE 12

Chemical Composition of Bags of 18-18-18 Fertilizer

| Bag No. | Analysis, percent N | Available $P_2O_5$ | $K_2O$ |
|---|---|---|---|
| 1 | 18.4 | 16.0 | 18.1 |
| 2 | 18.4 | 19.4 | 17.2 |
| 3 | 17.8 | 19.2 | 17.7 |
| 4 | 18.0 | 19.6 | 17.3 |
| 5 | 18.2 | 18.0 | 17.3 |
| 6 | 17.5 | 20.8 | 17.5 |
| Average | 18.1 | 18.8 | 17.5 |

It was concluded that the gravity-flow mixing tower would be suitable for blending the feed materials at submerged arc electric furnaces to provide a mixture in the furnace feed bin which is relatively uniform in composition. Matched sizes of feed materials would be prepared by agglomerating in similar low-temperature agglomerators. The proportion of liquid phase in the agglomrators will be the same. The materials will be mixed in a gravity-flow mixing tower which will discharge into the furnace feed bin. Segregation inside the submerged arc electric furnace will not occur because the components of the feed mixture have matched sizes.

EXAMPLE XII

Idaho shale was smelted in a submerged arc pilot-plant furnace for a 4-day test period. The shale had been calcined at a temperature of 2000° F. prior to smelting. The chemical and screen analyses are given in table 13.

TABLE 13

Chemical and Screen Analysis of Calcined Idaho Shale

| | |
|---|---|
| **Chemical analysis, percent** | |
| Moisture | 0.1 |
| $P_2O_5$ | 25.7 |
| CaO | 38.4 |
| $SiO_2$ | 25.3 |
| $Fe_2O_3$ | 1.5 |
| $Al_2O_3$ | 1.7 |
| F | 2.3 |
| C | 1.3 |
| $V_2O_5$ | 0.4 |
| **Screen analysis, percent** | |
| Plus 1 inch | 10 |
| Minus 1 inch plus ½ inch | 38 |
| Minus ½ inch plus ¼ inch | 36 |
| Minus ¼ inch plus 6 mesh | 12 |
| Minus 6 mesh | 4 |

A material balance showed that 75.2 percent of the vanadium oxide in the calcined Idaho shale was recovered as vanadium metal which was tapped from the furnace in ferrophosphorus. The vanadium metal content of the ferrophosphorus was as high as 4.6 percent. The recovery of vanadium may be increased by operating the submerged arc furnace under optimum electrical conditions, but these conditions were not determined during the pilot-plant test.

Phosphate ores contain iron oxides. The calcined Idaho shale contained 1.5 percent $Fe_2O_3$ as shown in table 13. When the phosphate ores are smelted in the phosphorus furnace the iron oxide is reduced to elemental iron. The iron combines with elemental phosphorus inside the furnace to produce ferrophosphorus—an alloy of iron and phosphorus. About 92 percent of the iron in iron oxide is recovered as ferrophosphorus. Vanadium oxide is reduced to vanadium metal and it is alloyed with the ferrophosphorus. Other metallurgical ores can be smelted in submerged arc electric furnaces. When phosphate ores contain chromium oxide or manganese oxide the metal oxides are reduced and the metal alloys with ferrophosphorus.

EXAMPLE XIII

The present example illustrates the conservation of energy during the preparation of nonsegregating feed mixtures for smelting metallurgical ores in submerged arc electric furnaces. I have not smelted metallurgical ores as described, but the example is based on smelting of phosphate ores which contain metal oxides.

Iron ore was dried to volatilize free and combined water. The ore was crushed and screened to obtain particles in the size range of ¼- to ½-inch, although the ore may be small sized beneficiated ore which contains no particles larger than ¼-inch. Limestone having particles smaller than ¼-inch was added to the minus ¼-inch ore to form a liquid slag in the furnace which carries sulfur along with it. Clay was added to the mixture of iron ore and limestone and it served as a binder during agglomeration. The iron oxide constituent in the clay was subsequently smelted to produce metallic iron.

The mixture of minus ¼-inch iron ore, limestone, and clay was agglomerated by tumbling in a rotary cylinder. Water was sprayed into the agglomerator to provide enough liquid phase to make agglomerates about ½-inch in size.

Agglomerates were discharged from the agglomerator into a nonagitated-bed indurating device which was a wire mesh belt enclosed in a metal housing. The wire mesh belt had openings about 0.05 square inch in area. Fines in the agglomerates sifted through the wire mesh, were collected, and were recycled to the agglomerator. The moving bed of agglomerates was exposed to flames from gas burners, and the agglomerates were heated to 425° F.

Metallurgical coke was crushed and screened to obtain particles in the size range of ¼- to ½-inch. Clay binder was added to the coke fines and the mixture was agglomerated in a rotating cylinder similar to the equipment used to agglomerate the iron ore fines. Water was sprayed into the agglomerator to provide liquid phase and the quantity of water was adjusted to produce agglomerates having about the same size as the iron ore agglomerates. The agglomerates were discharged onto a wire mesh belt similar to the one used to indurate iron ore agglomerates. The coke agglomerates were heated to 300° F. by hot air playing on the bed, and the air was heated in equipment shown in FIG. 4. The hot air was used as a heating medium instead of gas burners to prevent local overheating and ignition of the coke.

Samples of iron ore agglomerates and metallurgical coke agglomerates were taken for screen analysis and for segregation tests. The minus ¼-inch fines in the agglomerates were kept below about 10 percent by adjustment of the operating variables at the agglomerator. Samples were used to prepare mixtures which contained the approximate proportions of iron ore and coke used in smelting. Segregation tests were made with these mixtures in accordance with procedures described in examples VIII and IX. When the average deviation of the R index from unity was 5 percent, or less, the agglomerates were considered to have matched sizes. When the deviation was greater than 5 percent, adjustments were made at the agglomerators to produce agglomerates with more closely matched sizes.

The agglomerated and unagglomerated iron ore and metallurgical coke were put into one of two hoppers in proportions needed for smelting. The bottom gate of the hopper was opened to allow the material to discharge into a gravity-flow mixing tower described in example XI. Iron ore and coke were put into a second hopper while the first hopper was being discharged thereby providing essentially continuous blending. The furnace feed bin was insulated to prevent loss of heat to the surroundings.

The proportioned mixture of iron ore and coke flowed through chutes into the submerged arc electric furnace while still hot since the solid materials were not cooled after induration. The feed chutes extended from the bottom of the feed bin through the furnace roof into the furnace. Conical-shaped piles of material were formed inside the furnace and material rolled down the surface of the cones. The matched particle sizes of iron ore and coke kept the two materials from separating.

Iron ore contacted the CO gas generated in the furnace and $Fe_2O_3$ was reduced to FeO—a reduction reaction that begins at about 390° F. The temperature of the feed mixture was greater than 390° F. Energy expended for induration was used to reduce the iron ore and this reduced the quantity of electric energy required.

Combustible gas generated in the submerged arc furnace, consisting mainly of carbon monoxide and hydrogen, was cleaned by removing particulates and sulfur compounds. The gas was burned in equipment illustrated in FIG. 4 and air was heated to 350° F. The air was used to indurate the agglomerated coke. The gas was burned with approximately theoretical air to provide a nonoxidizing gas mixture consisting of carbon dioxide, nitrogen, and water vapor. The temperature of the gas was 425° F. and it was injected into the furnace feed bin and chutes to preheat the furnace feed mixture. Therefore, the present example discloses an energy conserving process for smelting metallurgical ores wherein the combustible gas generated in the submerged arc furnace is used to reduce the electric energy required for smelting.

EXAMPLE XIV

A test was made at a phosphorus furnace to investigate the addition of a nonoxidizing gas as a means of preventing the escape of the furnace gas through the feed bin. During normal furnace operation some of the furnace gas flows through the feed chutes into the feed bin and escapes into the working environment. These leakages occur when there is positive pressure on the furnace. When there is negative pressure, air flows into the furnace by way of feed bin and chutes. Explosions may occur in the feed bin, working area may be contaminated with toxic gases, and air brought into the furnace oxidizes phosphorus. The test was made to determine how much nonoxidizing gas would have to be put in the feed bin and chutes to prevent the escape of furnace gas and to prevent inleakage of air.

The furnace was operating at a powerload of about 34,000 kW and it was equipped with a carousel feed bin which had 14 compartments. Feed materials flowed from the compartments and discharged into the furnace. The sizes of the feed materials were unmatched. Consequently, the powerload varied as shown by the chart in FIG. 1 similar to operation with nodules. The pressure on the furnace was fluctuating similar to that shown in FIG. 2 with nodules.

A nonoxidizing gas, consisting of 88 percent nitrogen and 12 percent carbon monoxide, was injected into the top of each feed bin compartment. This gas was injected into one feed chute. The rates of gas injection varied, but the rates were limited by the quantity of nonoxidizing gas available.

Analysis of the gas in the carousel feed bin above the feed material showed that furnace gas continued to escape throughout the test period and it was assumed that air inleakage also continued. Results of the test showed that more than 450,000 standard cubic feet of nonoxidizing gas per day would be required to prevent the escape of furnace gas. But with unmatched sizes of feed materials it may be impossible to prevent the escape of furnace gas by adding nonoxidizing gases to the feed bin and chutes.

EXAMPLE XV

Pilot-plant experiments were made to determine the efficiency of nitric acid as a scrubbing medium to remove elemental phosphorus from furnace gas. The nitric acid solution was used to oxidize the elemental phosphorus to $P_2O_5$ and to absorb the $P_2O_5$ in the solution to form $H_3PO_4$.

The absorption tower was comprised of sections of terra-cotta pipe with an 8-inch inside diameter. An 18-foot section of the tower was packed with 1-inch stoneware rings and was the absorption section. A 28-inch section was packed with ½-inch stoneware rings and was provided to remove entrainment.

Gas from phosphorus furnaces was cooled in a condensing system to recover elemental phosphorus, and entrained elemental phosphorus in the gas was allowed to settle out in a gas holder. Various concentrations of nitric acid were used as the absorbent. The gas was sampled at the tower inlet and outlet and the samples were analyzed for elemental phosphorus. Data from three of the pilot-plant runs are given in table 14.

TABLE 14

Absorption of Elemental Phosphorus Vapor by Nitric Acid

| Run No. | Acid concentration, % $HNO_3$ | Phosphorus content of gas, lb. $P_4$/1000 cu. ft. Tower inlet | Tower outlet | Phosphorus removal, percent | Absorption coefficient, $K_{Ga}$[a] |
|---|---|---|---|---|---|
| 1 | 22.1 | 0.049 | 0.026 | 43 | 0.17 |
| 2 | 30.8 | 0.080 | 0.002 | 90 | 0.70 |
| 3 | 51.8 | 0.067 | 0.003 | 96 | — |

[a]Pounds per hour per square foot of tower cross-sectional area.

Many runs were made at the pilot plant and several variables were studied. The data for runs designated as 1, 2, and 3 are representative of those showing the effect of nitric acid concentration on the percent phosphorus removal. Concentrated nitric acid was a more efficient absorbent than dilute acid as shown in table 14. In the absorption process the gas film was controlling, and correlations of superficial gas velocity versus phosphorus removal were obtained. These data are useful in designing an absorption process to remove elemental phosphorus.

EXAMPLE XVI

Phosphorus furnace gas contains sulfur compounds apd it was found that these compounds are removed by absorption in nitric acid solution. Runs were made in the pilot-plant absorption tower described in example XV to determine the effectiveness of nitric acid solution for the removal of sulfur compounds. The data for three runs are given in table 15.

TABLE 15

Absorption of Sulfur Compounds by Nitric Acid

| Run No. | Acid concentration, percent $HNO_3$ | Sulfur content of gas, lb. S per 1000 cu. ft. Tower inlet | Tower outlet | Sulfur removal, percent |
|---|---|---|---|---|
| 1 | 22.3 | 0.014 | 0.001 | 93 |
| 2 | 31.6 | 0.075 | 0.011 | 85 |
| 3 | 51.8 | 0.044 | 0.002 | 95 |

As in example XV, many runs were made but results of three runs designated as 1, 2, and 3, were taken as representative. Nitric acid was an effective absorbent for the sulfur compounds in the furnace gas. Dilute nitric acid solution was more effective for the removal of sulfur compounds than it was for the removal of elemental phosphorus. For example, the sulfur content of the gas at the tower outlet was only 0.001 pound per 1000 cubic feet when the concentration of the nitric acid was 22.3 percent. The phosphorus content was 0.026 pound per 1000 cubic feet with about the same concentration of nitric acid.

EXAMPLE XVII

Phosphorus furnace gas was scrubbed in the pilot-plant absorption tower described in example XV. The phosphorus absorption efficiency was determined when concentrated sulfuric acid was used in the absorption tower. Data for three runs are given in table 16.

TABLE 16

Absorption of Elemental Phosphorus Vapor by Concentrated Sulfuric Acid

| Run No. | Acid concentration, % $H_2SO_4$ | Superficial gas velocity, ft/second[a] | $P_4$ content of gas, lb/1000 cu. ft. Tower inlet | Tower outlet | $P_4$ removal, % | Phosphorus absorption coefficient, $K_{Ga}$[b] |
|---|---|---|---|---|---|---|
| 1 | 88.6 | 0.24 | 0.031 | 0.005 | 85 | 0.26 |
| 2 | 88.0 | 0.96 | 0.080 | 0.006 | 93 | 1.4 |
| 3 | 88.6 | 1.15 | 0.067 | 0.003 | 95 | 1.9 |

[a]Based on cross-sectional area of empty tower.
[b]Pound moles of phosphorus removed per hour per cubic foot of tower volume per atmosphere of phosphorus partial pressure.

The data in table 16 show that concentrated sulfuric acid is an effective absorbent for elemental phosphorus vapor. The phosphorus is oxidized by the concentrated sulfuric acid to form $P_2O_5$ and the $P_2O_5$ is absorbed in the sulfuric solution forming phosphoric acid. This results in a mixture of sulfuric and phosphoric acids. When the elemental phosphorus was oxidized, a small amount of the sulfuric acid was reduced to $SO_2$. Therefore, the absorption tower outlet contained more sulfur than the inlet.

An alkaline scrubbing medium will be required to remove sulfur compounds from the gas when the elemental phosphorus is oxidized by concentrated sulfuric acid. At the pilot-plant absorption tower the sulfur compounds in the gas were absorbed in a sampling train in which a 5 percent sodium hydroxide solution was the absorbent. The scrubber solutions were analyzed for sulfur to determine the concentrations in the gas. This alkaline absorbent was not tested in the pilot-plant absorber, and data on the absorption efficiency were not obtained. Sulfur compounds can be absorbed in ammonium hydroxide and potassium hydroxide. These alkaline absorbents are preferred because they contain nutrients. The spent solutions can be used to make fluid fertilizers.

EXAMPLE XVIII

This example illustrates a process for cleaning phosphorus furnace gas so that it can be burned in a cogeneration facility. All the steps in the cogeneration process have not been carried out, but the entire process is described to explain the disclosure.

Phosphate ore was smelted in a plant comprised of two furnaces each of which operated at a powerload of 50,000 kW for a total load of 100,000 kW. The phosphorus production rate was 8 tons per hour. Noncondensable furnace gas was generated at a rate of 80,528 cubic feet (STP) per ton of phosphorus produced. Noncondensable gas is defined as all the gas except phosphorus vapor and water vapor. The gas contained 24.914 pounds of elemental phosphorus per 1000 cubic feet of noncondensable gas. The water vapor content was insignificant because the feed materials were dry.

The furnace gas was contacted with water in an adiabatic condensing system and the gas was cooled from about 660° F. to 145° F. Elemental phosphorus condensed and its concentration was reduced to about 0.325 pound of phosphorus per 1000 cubic feet of noncondensable gas. The gas was saturated with water at 145° F. and the concentration was 14.465 pounds water vapor per 1000 cubic feet of noncondensable gas.

The gas was further cooled to 128° F. in a tubular cooler which consisted of a tube bundle surrounded by cooling water. Gas flowed through the tubes. Both elemental phosphorus and water were condensed in the cooler and after cooling, the phosphorus content was 0.170 pound phosphorus per 1000 cubic feet of noncondensable gas. The water vapor content was 8.456 pounds per 1000 cubic feet.

The process described above was carried out as a normal part of the operation of a phosphorus furnace. About 99 percent of the phosphorus in the gas leaving the furnace was condensed and recovered. However, the gas was not a good fuel because the elemental phosphorus burns and causes air pollution in the stack gases. Also, the water vapor condenses and interferes with combustion.

Furnace gas was further cooled to 80° F. by scrubbing with cold water. This reduced the phosphorus content to 0.021 pound per 1000 cubic feet of noncondensable gas and the overall recovery of phosphorus was increased to 99.9 percent. The quantity of phosphorus remaining in the gas was 325 pounds per day. Further cooling of the furnace gas to recover elemental phosphorus was not considered economical because the scrubber water had to be refrigerated, and the cost of refrigeration was believed to be greater than the value of any additional phosphorus recovered. Water vapor content of the gas was 1.665 pounds per 1000 cubic feet of noncondensable gas. Nevertheless, the gas could be burned in rotary kilns without causing air pollution, and condensed water vapor did not interfere with combustion.

Composition of the gas was as follows: 0.7 percent $CO_2$; 0.1 percent $O_2$; 87.3 percent CO; 7.9 percent $H_2$; 2.3 percent $N_2$; 1.1 percent $CH_4$; and 0.6 percent unsaturated hydrocarbons taken to be $C_2H_2$. The heating value was calculated to be 343 Btu per cubic foot (STP). Potential energy in the gas as fuel was 27.619 million Btu per ton of phosphorus produced.

The furnace gas was further cleaned in order to permit the gas to be burned in a gas turbine. The gas was scrubbed with 90 percent sulfuric acid solution followed by scrubbing with 50 percent nitric acid. A final scrubbing with 5 percent ammonium hydroxide removed nitrogen oxides. The elemental phosphorus concentration in the cleaned gas was less than 0.001 pound per 1000 cubic feet as was the sulfur concentration.

The cleaned gas was burned in a gas turbine to generate electric energy at a rate of 2428 kWh per ton of phosphorus produced. The saving in electric energy was 19 percent of that required to smelt the ore, and this is equivalent to about $97 per ton of phosphorus produced.

EXAMPLE XIX

The absorbents in example XVIII became contaminated with material being removed from the gas stream. Phosphoric acid accumulated in the sulfuric acid and sulfuric acid accumulated in the nitric acid. Nitrogen compounds accumulated in the ammonium hydroxide. Streams of the recirculating acids and ammonium hydroxide were bled off and fresh materials were added to control the concentration of contaminants.

The acids bled off were combined forming a mixture comprised of sulfuric, nitric, and phosphoric acids. The mixture was ammoniated with contaminated ammonium hydroxide bled off the absorption tower, and attapulgite clay was added. Thus suspension fertilizer was produced containing ammonium phosphate, ammonium nitrate, and ammonium sulfate.

EXAMPLE XX

A process was disclosed in example XVIII for cleaning phosphorus furnace gas. This gas is frequently referred to as "byproduct CO gas" because it contains a larger percentage of carbon monoxide than any other gas.

In example XVIII the phosphorus furnace gas was cleaned by cooling in a three-step process to condense elemental phosphorus and water vapor. The gas was then scrubbed with oxidizing acids, but acidic constituents may remain after this treatment. In a final cleanup the gas was scrubbed with an alkaline solution. The cleaned gas was burned in a facility for the cogeneration of electric energy.

The present example discloses a process for disposing of the spent acid and spent alkaline solution. However, all the steps described were not carried out in the sequence disclosed.

Phosphate ore was smelted in a phosphorus furnace and the ore was reduced by metallurgical coke. The coke had the following proximate analysis on a dry basis: fixed carbon, 87.6 percent; volatile matter, 2.8 percent; and ash, 9.6 percent. The coke was dried in a rotary dryer prior to feeding to the phosphorus furnace. The volumetric analysis of the byproduct CO gas was as follows: $CO_2$, 0.7 percent; $O_2$, 0.1 percent; CO, 87.3 percent; $H_2$, 7.9 percent; $N_2$, 2.3 percent; $CH_4$, 1.1 percent; and $C_2H_2$, 0.6 percent. The gas was cleaned and the concentration of elemental phosphorus in the cleaned gas was less than 0.001 pound per 1000 cubic feet. Also, the concentration of sulfur compounds, expressed as sulfur, was less than 0.001 pound per 1000 cubic feet. The gas contained 1.665 pounds of water vapor per 1000 cubic feet.

The cleaned gas was burned with theoretical air in the air heater shown in FIG. 4. A nonoxidizing gas mixture was produced which had the following volumetric composition: $CO_2$, 30.1 percent; $N_2$, 65.3 percent; and water vapor, 4.6 percent. The gas temperature was 300° F. and its dewpoint was 89° F.

Matched sizes of feed material were used in the phosphorus furnace and the average temperature of the feed mixture was 200° F. The furnace pressure fluctuations were similar to the fluctuations recorded on the chart shown in FIG. 2. The data from 6:00 a.m. to midnight refer to operation with matched sizes of feed materials.

The nonoxidizing gas was injected into the feed bin and feed chutes and the materials were heated from contact with the gas. This preheat decreased the electric energy required for smelting.

Injection of the nonoxidizing gas into the feed bin and chutes prevented the escape of furnace gas into the working environment. Also, inleakage of air was prevented which increased recovery of phosphorus about 0.5 percent.

EXAMPLE XXI

As in example XX, phosphate ore was smelted in a phosphorus furnace. However, low volatile matter bituminous coal was the reducing carbon, and it had the following proximate analysis on a dry basis: fixed carbon 78.7 percent; volatile matter, 14.7 percent; and ash, 6.6 percent. Matched sizes of feed materials were used in the furnace. Byproduct CO gas had the following volumetric analysis: $CO_2$, 1.0 percent; $O_2$, 0.1 percent; CO, 76.1 percent, $H_2$, 18.2 percent; $CH_4$, 2.2 percent; and $N_2$, 2.4 percent (by difference).

The byproduct CO gas was cleaned to reduce the phosphorus concentration to less than 0.001 pound per 1000 cubic feet. The concentration of combined sulfur compounds was also reduced to less than 0.001 pound per 1000 cubic feet when the compounds were expressed as sulfur.

Cleaned gas was burned in the air heater shown in FIG. 4 to produce a nonoxidizing gas mixture which had the following composition: $CO_2$, 26.8 percent; $N_2$, 64.7 percent; and $H_2O$, 8.5 percent. Temperature of the gas was 450° F., and its dewpoint was 109° F.

The nonoxidizing gas was injected into the feed bin and chutes to prevent escape of furnace gas and inleakage of air. The hot gas preheated the feed materials to 425° F. When the preheated phosphate ore contacted carbon monoxide inside the furnace, ferric oxide in the ore was reduced to ferrous oxide. Reduction of ferric oxide begins at a temperature of about 390° F. Part of the energy in the hot gas mixture was absorbed by reduction of ferric oxide, and electric energy for smelting the phosphate ore was reduced.

EXAMPLE XXII

Technology has not been available which would enable one to agglomerate reducing carbons for use in electric furnaces. High-temperature agglomeration has been precluded because the carbon oxidizes. Coal tar pitch can be used as a binder to agglomerate carbon particles, but pitch is too costly for the agglomeration of reducing carbons.

The agglomeration process discussed in the present patent application does not require high temperatures, and carbonaceous materials are not burned. The binder is monocalcium phosphate monohydrate and it contains about 48 percent $P_2O_5$. The binder is made from ground phosphate ore and phosphoric acid; the latter may contain a large percentage of impurities such as phosphoric acid sludge precipitated from wet-process phosphoric acid, or impure phosphoric acid produced from phosphorus sludge. Monocalcium phosphate upgrades phosphorus furnace feed mixture by increasing the percent $P_2O_5$ in phosphate plus silica rock. Phosphate ores can be smelted which otherwise are impractical to use as a source of phosphorus. This will substantially reduce the cost of producing elemental phosphorus.

Some carbonaceous materials are potential sources of reducing carbons but the particles are too small. These small sized particles become entrained and are carried out of the furnace. Also, small sized particles separate from the feed mixture as a result of segregation. The cost of some small sized carbonaceous materials is much less than the cost of metallurgical coke. Some of the carbonaceous materials are wastes. The agglomeration processes will result in lower phosphorus production costs because matched sizes of feed materials can be made and low-cost carbonaceous materials can be used as reducing carbons.

In the present example, phosphate ores were smelted in a laboratory furnace with various carbonaceous materials as reducing carbons. The smelting experiments were carried out in a Globar electric furnace equipped with a silica tube 30 inches long. The inside diameter of the tube was 1 inch. A graphite crucible containing the mixture of phosphate ore, silica rock, and carbonaceous material was placed inside the silica tube. The crucible had a tight-fitting graphite cover; a 1/16-inch-diameter hole was drilled in the cover to permit the gases to escape. Temperatures inside the silica tube were controlled by a Variac voltage regulator installed in the electric circuit. The test assembly also provided for the addition of nitrogen to the silica tube to carry out gases volatilized from the crucible. Moisture and oxygen were removed from the nitrogen before it entered the silica tube.

Representative samples of phosphate ore and washed silica gravel were obtained for the tests. The compositions of these samples are given in table 17.

TABLE 17

| Analysis of Phosphate Ore and Silica Rock | Chemical analysis, % on dry basis | | | |
|---|---|---|---|---|
| | $P_2O_5$ | CaO | $SiO_2$ | $Fe_2O_3$ |
| Nodulized phosphate ore | | | | |
| Sample A | 26.6 | 36.8 | 20.2 | 3.9 |
| Sample B | 24.0 | 34.1 | 27.5 | 4.3 |
| Silica | — | 0.1 | 96.2 | 1.2 |

The types and compositions of the various carbons tested are given in table 18.

TABLE 18

Types and Compositions of Carbons Used in Laboratory Experiments

| Reducing carbon | Analysis of reducing carbon, % dry basis: Volatile matter | Ash | Fixed carbon | Description |
|---|---|---|---|---|
| Metallurgical coke | | | | |
| Sample A | 2.8 | 9.6 | 87.6 | Typical coke used in phosphorus furnaces. Coke was made in by-product coke ovens. |
| Sample B | 0.5 | 7.1 | 92.4 | Coke was made in beehive ovens. |
| Graphite | 0.3 | 0.3 | 99.4 | Graphite from an electric furnace electrode. |
| Petroleum coke | | | | |
| Sample A | 11.1 | 0.0 | 88.9 | Green petroleum coke; uncalcined product of refinery coke drums. |
| Sample B | 4.9 | 0.0 | 95.1 | Calcined at temperature of about 1600° F. |
| Sample C | 0.5 | 0.0 | 99.5 | Calcined at temperature of 2500° F. |
| Charcoal | 10.1 | 4.8 | 85.1 | Hardwood charcoal which had been produced by heating wood to a temperature of 1300° F. |
| Char | | | | |
| Sample A | 0.5 | 4.4 | 95.1 | Char samples were obtained by heating bituminous coal. |
| Sample B | 3.1 | 4.5 | 92.4 | |
| Sample C | 9.9 | 3.5 | 86.6 | |
| Anthracite coal | 4.2 | 9.8 | 86.0 | Commercial rice size anthracite. |
| Semianthracite coal | 11.8 | 8.2 | 80.0 | Coal from Arkansas deposit. |
| Low-volatile bituminous coal | 14.1 | 5.2 | 80.7 | Coal from West Virginia deposit. |
| Medium-volatile bituminous coal | 21.2 | 7.8 | 71.0 | Coal from Tennessee deposit. |
| High-volatile bituminous coal | 33.4 | 12.2 | 54.4 | Coal from Alabama deposit. |
| Coal tar pitch | | | | |
| Sample A | 44.3 | 0.1 | 55.6 | Softening point 285°-315° F. |
| Sample B | 50.5 | 0.1 | 49.4 | Softening point 221°-239° F. |
| Sample C | 68.1 | 0.2 | 31.7 | Softening point 140°-150° F. |
| Sample D | 70.6 | 0.3 | 29.1 | Liquid at room temperature |

The phosphate, silica rock, and reducing carbon were pulverized so that the particles were smaller than 100 mesh, except the coal tar pitch was not pulverized. Five grams of phosphate was weighed out and enough silica rock was added to provide a $SiO_2$:CaO weight ratio of 0.82. The reducing carbon was added in proportions needed to provide 104 percent of the theoretical carbon requirement, based on fixed carbon analysis.

The materials were placed in the graphite crucible and the crucible was covered. The crucible and its contents were heated for 30 minutes at a temperature of 2500° F. Nitrogen was passed through the silica tube at a rate of 14 liters per hour. At the end of an experiment the contents of the crucible were removed, weighed, and analyzed for $P_2O_5$. The amount of phosphorus volatilized from the mixture was calculated from the weights and $P_2O_5$ contents before and after the mixture was heated. At least three experiments were made with each reducing carbon. Results of the experiments are given in table 19.

TABLE 19

Volatilization of Phosphorus by Various Reducing Carbons

| Reducing carbon | Phosphate used | No. of experiments | Volatilization of phosphorus, %: Range | Average |
|---|---|---|---|---|
| Metallurgical coke | | | | |
| Sample A | Sample A | 18 | 77-78 | 77 |
| Sample B | Sample A | 6 | 74-76 | 75 |
| Graphite | Sample A | 6 | 72-73 | 73 |
| Petroleum coke | | | | |
| Sample A | Sample B | 3 | 82-83 | 82 |
| Sample B | Sample B | 3 | 79-81 | 80 |
| Sample C | Sample B | 3 | 81-82 | 82 |
| Charcoal | Sample A | 6 | 76-79 | 78 |
| Char | | | | |
| Sample A | Sample A | 6 | 76-79 | 78 |
| Sample B | Sample A | 4 | 70-72 | 71 |
| Sample C | Sample A | 6 | 69-72 | 70 |
| Anthracite coal | Sample A | 3 | 82 | 82 |
| Semianthracite coal | Sample B | 5 | 75-78 | 77 |
| Low-volatile bituminous coal | Sample B | 6 | 82 | 82 |
| Medium-volatile bituminous coal | Sample B | 3 | 85 | 85 |
| High-volatile bituminous coal | Sample A | 3 | 86-88 | 87 |
| Coal tar pitch | | | | |
| Sample A | Sample A | 6 | 81-88 | 85 |
| Sample B | Sample A | 6 | 84-90 | 87 |
| Sample C | Sample A | 3 | 79-88 | 84 |
| Sample D | Sample A | 4 | 74-86 | 80 |

The experiments were planned to measure the chemical reactivity of a wide range of reducing carbons, and a reaction temperature of 2500° F. was selected because metallurgical coke rapidly reduces phosphate ore at this temperature. But there is no physical separation of small sized coke particles from the phosphate ore as occurs in furnaces used to produce elemental phosphorus. The slag is not fluid enough for the carbon to separate.

The data in table 19 show that a wide range of carbon sources will reduce phosphate ores. Petroleum coke had chemical reactivities greater than those of metallurgical coke, as measured by the percent volatilization of phosphorus. Charcoal—a forest product—had chemical reactivities about the same as metallurgical coke. From these data it appears that waste carbonaceous materials, such as sawdust and scrap lumber, can be used as reducing carbons provided the waste materials possess physical properties suitable for use in phosphorus furnaces.

Sewage sludge is another waste material which contains 31 percent organic carbon on a dry basis. The organic carbon is derived from paper and other organic materials which can be carbonized to make reducing carbon suitable for the reduction of phosphate ore.

Having thus described the invention, what is claimed is:

1. A process for smelting ores wherein the ore, reducing carbon, and a flux react in a submerged arc electric furnace to produce metals, slag, and a combustible gas, said process consisting of the following steps:

(a) crushing and screening metallurgical ore to obtain particles smaller than $\frac{1}{2}$-inch and larger than $\frac{1}{4}$-inch;

(b) adding minus $\frac{1}{4}$-inch flux to minus $\frac{1}{4}$-inch fines from step (a);

(c) agglomerating mixture from step (b) by tumbling with a binder;

(d) indurating agglomerates formed in step (c) in a nonagitated heating device;

(e) crushing and screening reducing carbon to obtain particles smaller than ½-inch and larger than ¼-inch;

(f) agglomerating minus ¼-inch reducing carbon from step (e) by tumbling with a binder, said agglomerates having about the same average particle size and particle size distribution as agglomerates produced in step (c);

(g) indurating agglomerates formed in step (f) in a nonagitated heating device;

(h) sampling indurated agglomerates from step (d) and step (g) and mixing said samples in proportions required for smelting;

(i) testing mixtures from step (h) to determine the R index;

(j) adjusting operating variables in step (c) and step (f) to prepare mixtures in step (i) having R indices which vary from unity by less than 5 percent;

(k) feeding minus ½-inch plus ¼-inch metallurgical ore from step (a), agglomerated metallurgical ore from step (d), minus ½-inch plus ¼-inch reducing carbon from step (e), and agglomerated reducing carbon from step (g) to a hopper in proportions required for smelting;

(l) discharging materials from step (k) into a gravity-flow mixing tower;

(m) discharging material from step (l) into feed bin;

(n) discharging materials from step (m) into submerged arc electric furnace by means of feed chutes extending from feed bin through roof of furnace; and (o) smelting mixture of metallurgical ore, flux, and reducing carbon from step (n) in submerged arc electric furnace.

2. The process of claim 1 wherein the metallurgical ore is taken from the group comprised of iron ore, vanadium ore, manganese ore, and chromium ore.

3. The process of claim 1 wherein the metallurgical ore in step (a) is crushed and screened to obtain particles smaller than 1 inch and larger than ¼-inch.

4. The process of claim 1 wherein the reducing carbon in step (e) is crushed and screened to obtain particles smaller than 1 inch and larger than ¼-inch.

5. The process of claim 1 wherein the metallurgical ore in step (a) consists of particles smaller than ¼-inch.

6. The process of claim 1 wherein the reducing carbon in step (e) consists of particles smaller than ¼-inch.

7. The process of claim 1 wherein agglomerates in step (d) and step (g) are indurated in the temperature range of 240° to 900° F.

8. The process of claim 1 wherein the nonagitated heating device in step (d) and step (g) is a wire mesh belt having openings about 0.05 square inch in area, said wire mesh belt being enclosed in a housing, and said enclosure being heated by gas flames.

9. The process of claim 1 wherein the binder used in step (c) and step (f) is smelted.

10. The process of claim 1 wherein the gravity-flow mixing tower in step (l) and the feed bin in step (m) are insulated.

* * * * *